US005836586A

United States Patent [19]

Marks et al.

[11] Patent Number: 5,836,586

[45] Date of Patent: Nov. 17, 1998

[54] METHOD OF PLAYING A MODIFIED TWENTY-ONE CARD GAME

[75] Inventors: Howard M. Marks, Westport, Conn.; Anthony M. Singer, Brooklyn, N.Y.

[73] Assignee: PTT, LLC, Westport, Conn.

[21] Appl. No.: 859,394

[22] Filed: May 20, 1997

Related U.S. Application Data

[60] Provisional application No. 60/034,058 Jan. 8, 1997.

[51] Int. Cl.[6] ..... A63F 1/00

[52] U.S. Cl. ..... 273/292; 463/12

[58] Field of Search ..... 273/292, 274, 273/309

[56] References Cited

U.S. PATENT DOCUMENTS

| | | | |
|---|---|---|---|
| 5,174,579 | 12/1992 | Griffiths | 273/292 |
| 5,248,142 | 9/1993 | Breeding | 273/292 |
| 5,257,810 | 11/1993 | Schorr et al. | 273/292 |
| 5,275,416 | 1/1994 | Schorr et al. | 273/292 |
| 5,280,915 | 1/1994 | Groussman | 273/292 |
| 5,390,934 | 2/1995 | Grassa | 273/292 |
| 5,395,119 | 3/1995 | Jacob et al. | 273/274 |
| 5,454,570 | 10/1995 | Karal | 273/292 |
| 5,494,296 | 2/1996 | Grassa | 273/292 |
| 5,542,669 | 8/1996 | Charron et al. | 463/13 |
| 5,584,485 | 12/1996 | Jones et al. | 273/292 |
| 5,586,766 | 12/1996 | Forte et al. | 273/309 |
| 5,611,730 | 3/1997 | Weiss | 463/20 |
| 5,615,888 | 4/1997 | Lofink et al. | 273/292 |
| 5,626,341 | 5/1997 | Jones et al. | 273/292 |
| 5,632,485 | 5/1997 | Woodland et al. | 273/292 |
| 5,636,842 | 6/1997 | Cabot et al. | 273/292 |
| 5,636,843 | 6/1997 | Roberts | 273/292 |
| 5,639,092 | 6/1997 | Macaisa | 273/292 |
| 5,645,281 | 7/1997 | Hesse et al. | 273/292 |
| 5,649,705 | 7/1997 | String | 273/292 |
| 5,660,391 | 8/1997 | Klasee | 273/292 |
| 5,660,392 | 8/1997 | Hansen | 273/292 |
| 5,660,393 | 8/1997 | Dreger | 273/292 |

OTHER PUBLICATIONS

"Maverick Blackjack", May 1995.

"Top O' The Deck Blackjack", Sam's Town Hotel and Gambling Hall, May 1995.

*Primary Examiner*—Benjamin H. Layno

*Attorney, Agent, or Firm*—Pepper Hamilton LLP

[57] ABSTRACT

A method of playing a modified twenty-one card game by at least a dealer includes the steps of placing a wager awarded when the player bets that the dealer will score at least one of a predetermined number of dealer outcomes, and playing the twenty-one game. The method also includes the steps of determining the score of the dealer, and comparing the score of the dealer to the predetermined number of dealer outcomes bet by the player. The player is awarded responsive to the wager and a coincidence between the dealer score and one of the predetermined number of dealer outcomes.

28 Claims, 38 Drawing Sheets

SIX DECKS

6 DECKS
500,000 DEALS

| FINAL COUNT | PAYOFF ACE UP IN 2 CARDS | PAYOFF OTHER WAYS | FREQ ANY CARDS | FREQ ACE UP IN 2 CARDS | FREQ OTHER WAYS | PAYOFF 500,000 DEALS W/ACE IN 2 & OTHER WAYS | CASINO'S HOLD PERCENTAGE |
|---|---|---|---|---|---|---|---|
| 17 | 20 | 6 | 72912 | 2959 | 69953 | 478898 | 4.2204 |
| 18 | 25 | 6 | 69817 | 2959 | 66858 | 475123 | 4.9754 |
| 19 | 30 | 6 | 67217 | 2959 | 64258 | 474318 | 5.1364 |
| 20 | 40 | 4 | 89682 | 2959 | 86723 | 465252 | 6.9496 |
| 21 | 15 | 6 | 59908 | 11667 | 48241 | 464451 | 7.1098 |
| BUST | 15 | 3 | 140386 | 4367 | 136019 | 473562 | 5.2876 |

Fig. 2A

STANDARD PLAY WITHOUT ACE COUNTING

STAND ON ALL 17'S
6 DECKS
1,000,000 DEALS

| FINAL COUNT | PAYOFF ACE UP IN 2 CARDS | PAYOFF OTHER WAYS | FREQ ANY CARDS | FREQ ACE UP IN 2 CARDS | FREQ OTHER WAYS | [1,000,000] PAYOFF 1,00,000 DEALS W/ACE IN 2 & OTHER WAYS | CASINO'S HOLD PERCENTAGE |
|---|---|---|---|---|---|---|---|
| 17 | 20 | 6 | 144727 | 5903 | 138824 | 951004 | 4.8996 |
| 18 | 25 | 6 | 139295 | 5795 | 133500 | 945875 | 5.4125 |
| 19 | 30 | 6 | 133883 | 5861 | 128022 | 943962 | 5.6038 |
| 20 | 40 | 4 | 179649 | 6062 | 173587 | 936828 | 6.3172 |
| 21 | 10 | 7 | 120406 | 23837 | 96569 | 914353 | 8.5647 |
| BUST | 15 | 3 | 282040 | 8946 | 273094 | 953472 | 4.6528 |

Fig. 2B

STEP UP STRATEGY AT 50

STAND ON ALL 17'S
6 DECKS
1,000,000 DEALS

| FINAL COUNT | PAYOFF ACE UP IN 2 CARDS | PAYOFF OTHER WAYS | FREQ ANY CARDS | FREQ ACE UP IN 2 CARDS | FREQ OTHER WAYS | [4,627,487] PAYOFF 1,00,000 DEALS W/ACE IN 2 & OTHER WAYS | CASINO'S HOLD PERCENTAGE |
|---|---|---|---|---|---|---|---|
| 17 | 20 | 6 | 144727 | 5903 | 138824 | -113025 | 2.4426 |
| 18 | 25 | 6 | 139295 | 5795 | 133500 | -193780 | 4.1878 |
| 19 | 30 | 6 | 133883 | 5861 | 128022 | -157887 | 3.4121 |
| 20 | 40 | 4 | 179649 | 6062 | 173587 | -144039 | 3.1128 |
| 21 | 10 | 7 | 120406 | 23837 | 96569 | -94583 | 2.0440 |
| BUST | 15 | 3 | 282040 | 8946 | 273094 | -214056 | 4.6260 |

Fig. 2C

STANDARD PLAY WITHOUT ACE COUNTING

HIT SOFT 17'S
6 DECKS
1,000,000 DEALS

| FINAL COUNT | PAYOFF ACE UP IN 2 CARDS | PAYOFF OTHER WAYS | FREQ ANY CARDS | FREQ ACE UP IN 2 CARDS | FREQ OTHER WAYS | [1,000,000] PAYOFF 1,00,000 DEALS W/ACE IN 2 & OTHER WAYS | CASINO'S HOLD PERCENTAGE |
|---|---|---|---|---|---|---|---|
| 17 | 35 | 6 | 133185 | 4371 | 128814 | 925869 | 7.4131 |
| 18 | 20 | 6 | 141349 | 5804 | 135545 | 929350 | 7.0650 |
| 19 | 25 | 6 | 135934 | 5829 | 130105 | 926355 | 7.3645 |
| 20 | 40 | 4 | 181880 | 5942 | 175938 | 941432 | 5.8568 |
| 21 | 10 | 7 | 122276 | 23626 | 98650 | 926810 | 7.3190 |
| BUST | 10 | 3 | 285376 | 10632 | 274744 | 930552 | 6.9448 |

Fig. 2D

STEP UP STRATEGY AT 50

HIT SOFT 17'S
6 DECKS
1,000,000 DEALS

| FINAL COUNT | PAYOFF ACE UP IN 2 CARDS | PAYOFF OTHER WAYS | FREQ ANY CARDS | FREQ ACE UP IN 2 CARDS | FREQ OTHER WAYS | [4,625,439] PAYOFF 1,00,000 DEALS W/ACE IN 2 & OTHER WAYS | CASINO'S HOLD PERCENTAGE |
|---|---|---|---|---|---|---|---|
| 17 | 35 | 6 | 133185 | 4371 | 128814 | -268287 | 5.7979 |
| 18 | 20 | 6 | 141349 | 5804 | 135545 | -270321 | 5.8419 |
| 19 | 25 | 6 | 135934 | 5829 | 130105 | -232219 | 5.0185 |
| 20 | 40 | 4 | 181880 | 5942 | 175938 | -124923 | 2.6997 |
| 21 | 10 | 7 | 122276 | 23626 | 98650 | -7048 | 0.1523 |
| BUST | 10 | 3 | 285376 | 10632 | 274744 | -335782 | 7.2566 |

Fig. 2E

STANDARD PLAY WITHOUT ACE COUNTING

HOLD ON ALL 17'S
1 DECK
1,000,000 DEALS

| FINAL COUNT | PAYOFF ACE UP IN 2 CARDS | PAYOFF OTHER WAYS | FREQ ANY CARDS | FREQ ACE UP IN 2 CARDS | FREQ OTHER WAYS | [1,000,000] PAYOFF 1,00,000 DEALS W/ACE IN 2 & OTHER WAYS | CASINO'S HOLD PERCENTAGE |
|---|---|---|---|---|---|---|---|
| 17 | 15 | 6 | 146031 | 5917 | 140114 | 929439 | 7.0561 |
| 18 | 20 | 6 | 138019 | 5968 | 132051 | 911666 | 8.8334 |
| 19 | 25 | 6 | 135352 | 6092 | 129260 | 927860 | 7.2140 |
| 20 | 40 | 4 | 175652 | 6093 | 169559 | 921956 | 7.8044 |
| 21 | 10 | 6 | 121476 | 23782 | 97694 | 823984 | 17.6016 |
| BUST | 15 | 3 | 283470 | 8989 | 274481 | 958278 | 4.1722 |

Fig. 2F

STEP UP STRATEGY AT 50

HOLD ON ALL 17'S
1 DECK
1,000,000 DEALS

| FINAL COUNT | PAYOFF ACE UP IN 2 CARDS | PAYOFF OTHER WAYS | FREQ ANY CARDS | FREQ ACE UP IN 2 CARDS | FREQ OTHER WAYS | [21,025,981] PAYOFF 1,00,000 DEALS W/ACE IN 2 & OTHER WAYS | CASINO'S HOLD PERCENTAGE |
|---|---|---|---|---|---|---|---|
| 17 | 15 | 6 | 133185 | 4371 | 128814 | -632680 | 3.0090 |
| 18 | 20 | 6 | 141349 | 5804 | 135545 | -1323027 | 6.2923 |
| 19 | 25 | 6 | 135934 | 5829 | 130105 | -638728 | 3.0378 |
| 20 | 40 | 4 | 181880 | 5942 | 175938 | -214201 | 1.0187 |
| 21 | 10 | 6 | 122276 | 23626 | 98650 | -801289 | 3.8109 |
| BUST | 15 | 3 | 285376 | 10632 | 274744 | -828820 | 3.9419 |

Fig. 2G

DEALER

| FINAL COUNT | PAYOFF ANY CARDS | PAYOFF W/ACE IN 2 CARDS | PAYOFF OTHER WAYS | FREQ ANY CARDS | FREQ W/ACE IN 2 CARDS | FREQ OTHER WAYS | PAYOFF ANY CARDS | PAYOFF W/ACE IN 2 & OTHER WAYS |
|---|---|---|---|---|---|---|---|---|
| 17 | 6.5 | 12 | 6 | 14602 | 1200 | 13402 | 94913 | 94812 |
| 18 | 7 | 15 | 6 | 13993 | 1200 | 12793 | 97951 | 94758 |
| 19 | 7 | 18 | 6 | 13395 | 1200 | 12195 | 93765 | 94770 |
| 20 | 5.5 | 24 | 4 | 17666 | 1200 | 16466 | 97163 | 94664 |
| BUST + BJ | 3 | 3 | 3 | 32947 | 4757 | 28190 | 98841 | 98841 |

Fig. 14B

PROGRESSIVE PAYOFFS
FUNDING OF EACH PAYOFF COMES FROM THE PROGRESSIVE COIN
THE PROGRESSIVE PAYS OFF, IF AND ONLY IF, THE PLAYER BETS A COIN ON THE PROGRESSIVE.
[FREQUENCY OF WINNING IS BASED ON 1,000 MACHINE NETWORK]
1000 MACHINES PLAYING AT 4 TIMES A MINUTE FOR 10 HOURS PER DAY =1000X4X60X10 = 2,400,000 PLAYS PER DAY

BLACK JACK WITH ANY ACE UP
AND ANY BLACK JACK PAYS 7 TIMES
ODDS OF ACE & BJ 338 PER DAY
PERCENTAGE 0.002958 PER MACHINE
PAYOFF 200 59.17%

ACE DEUCE THREE FOUR
MIXED SUITS

| | | | |
|---|---|---|---|
| ACE | 0.0769 | | |
| 2 OR 3 | 0.1538 | | |
| 2 OR 3 NE | 0.0769 | | |
| 4 | 0.0769 | PAYS 1 TIME | |
| ODDS | 14,280.5 | PER DAY | |
| PCT | 0.0000700256 | PER 5 MACHINES | |
| PAYOFF, FUNDED BY 1/7 OF A COIN | 2,040 | 1,000 | 7.00% |

ACE DEUCE THREE FOUR FIVE SIX
MIXED SUITS

| | | | |
|---|---|---|---|
| ACE | 0.0769 | | |
| 2 OR 3 | 0.1538 | | |
| 2 OR 3 NE | 0.0769 | | |
| 6 | 0.0769 | | |
| 4 | 0.0769 | | |
| 5 | 0.0769 | FOR 1,000 UNITS | |
| ODDS | 2,413,494.5 | PAYS ONCE | |
| PCT | 0.0000004144 | EACH DAY | |
| PAYOFF, FUNDED BY 1/7 OF A COIN | 344,772 | 250,000 | 10.36% |

ACE DEUCE THREE FOUR
ALL SAME COLOR (RED OR BLACK)

| | | | |
|---|---|---|---|
| ACE | 0.0769 | | |
| 2 OR 3 | 0.0769 | | |
| 2 OR 3 NE | 0.0385 | | |
| 4 | 0.0385 | PAYS 1 TIME | |
| ODDS | 114,244.0 | PER WEEK | |
| PCT | 0.0000067532 | PER 7 MACHINES | |
| PAYOFF, FUNDED BY 1/7 OF A COIN | 16,321 | 7,500 | 6.56% |

ACE DEUCE THREE FOUR FIVE SIX
ALL SAME COLOR (RED OR BLACK)

| | | | |
|---|---|---|---|
| ACE | 0.0769 | | |
| 2 OR 3 | 0.0769 | | |
| 2 OR 3 NE | 0.0385 | | |
| 6 | 0.0385 | | |
| 4 | 0.0385 | | |
| 5 | 0.0385 | FOR 1,000 UNITS | |
| ODDS | 77,228,944.0 | PAYS ONCE | |
| PCT | 0.0000000129 | A MONTH | |
| PAYOFF, FUNDED BY 1/7 OF A COIN | 11,032,706 | 1,000,000 | 1.29% |

ACE DEUCE THREE FOUR
ALL SAME SUITS

| | | | |
|---|---|---|---|
| ACE | 0.0769 | | |
| 2 OR 3 | 0.0385 | | |
| 2 OR 3 NE | 0.0192 | | |
| 4 | 0.0192 | PAYS 1 TIME | |
| ODDS | 913,952.0 | PER MONTH | |
| PCT | 0.0000010941 | PER 12 MACHINES | |
| PAYOFF, FUNDED BY 1/7 OF A COIN | 130,565 | 75,000 | 8.21% |
| | | | 80.95% |

ACE DEUCE THREE FOUR FIVE SIX
ALL SAME SUITS

| | | | |
|---|---|---|---|
| ACE | 0.0769 | | |
| 2 OR 3 | 0.0385 | | |
| 2 OR 3 NE | 0.0192 | | |
| 6 | 0.0192 | | |
| 4 | 0.0192 | | |
| 5 | 0.0192 | FOR 1,000 UNITS | |
| ODDS | 2,471,326,208.0 | PAYS ONCE IN | |
| PCT | 0.0000000004 | THREE YEARS | |
| PAYOFF, FUNDED BY 1/7 OF A COIN | 353,045,601 | 19,000,000 | 0.40% |
| | | | 12.06% 93.00% |

Fig. 29A

MULTI-LEVEL PROGRESSIVES
USING
5,6,7,8 CARD CHARLIES

| | ACE UP, WITH A BLACK JACK | ACE UP, 5 CARD CHARLEY | ACE UP, 6 CARD CHARLEY | ACE UP, 7 CARD CHARLEY | ACE UP, 8 OR 9 CARD CHARLEY | (20 YEAR ANNUITY) | (NET PRESENT VALUE) |
|---|---|---|---|---|---|---|---|
| PROGRESSIVE MONEY | 0 | 0 | 200 | 4,000 | 467,000 | 23,350 | 267,823 |
| SEED MONEY | 100 | 150 | 1,000 | 10,000 | 1,000,000 | 50,000 | 573,496 |
| AMOUNT BET | 1.00 | 1.00 | 1.00 | 1.00 | 1.00 | AT 6% INTEREST RATE | AT 6% INTEREST RATE |
| ODDS | 338 TO 1 | 575 TO 1 | 6,020 TO 1 | 151,229 TO 1 | 9,162,054 TO 1 | | |
| ODDS AS ADECIMAL | 0.00295858 | 0.00173611 | 0.00015611 | 0.00000661 | 0.00000011 | | |
| % TO PROGRESSIVE | 0.000000% | 0.000000% | 3.322259% | 2.644995% | 2.923173% | | |
| % TO SEED MONEY | 29.585799% | 26.041667% | 16.611296% | 6.612488% | 6.259470% | | |

| | INCREASE ON PROGRESSIVE PER 500 UNITS PER MINUTE | WINS PER 500 UNITS | INCREASE ON PROGRESSIVE PER 25 UNITS PER MINUTE | WINS PER 25 UNITS |
|---|---|---|---|---|
| ACE UP WITH A BLACK JACK | | 1 WIN EACH 7 1/2 SECONDS | | 1 WIN EACH 3 MINUTES |
| ACE UP, 5 CARD CHARLEY | | 1 WIN EACH 12 SECONDS | | 1 WIN EACH 4 MINUTES |
| ACE UP, 6 CARD CHARLEY | $83.06 | 1 WIN EACH 2 MINUTES | $4.15 | 1 WIN EACH 40 MINUTES |
| ACE UP, 7 CARD CHARLEY | $66.12 | 1 WIN EACH 1 HOUR | $3.31 | 1 WIN EACH 2 DAYS |
| ACE UP, 8/9 CARD CHARLEY | $73.06 | 1 WIN EACH 6 DAYS | $3.65 | 1 WIN EACH 4 MONTHS |

ALL CALCULATIONS ARE BASED ON THE FOLLOWING ASSUMPTIONS:

EACH MACHINE WILL BE ACTIVELY PLAYED FOR 10 HOURS PER DAY

A PLAYER WILL AVERAGE 5 PLAYS PER MINUTE.

Fig. 29B

MULTI-LEVEL PROGRESSIVES
USING
5,6,7,8 CARD CHARLIES

VIDEO GAME VERSION WITH 52 CARD DECK
BONUS AND PROGRESSIVE PAYOFFS

| ODDS | TYPE OF WIN | % PAYOFF | EXPEXTED PAYOFF | SEED MONEY | % TO SEED MONEY | % TO PROGRESSIVE | SEED AFTER A CYCLE 9,162,054 PLAYS | PROGRESSIVE AFTER A CYCLE 9,162,054 PLAYS | TOTAL PAYOFF AFTER A CYCLE 9,162,054 PLAYS |
|---|---|---|---|---|---|---|---|---|---|
| 338 | ACE UP & BLACK JACK DOWN | 29.5858% | 100 | 100 | 29.585799 | 0.000000 | 2,710,667 | 0 | 2,710,667 |
| 576 | ACE UP: 5 CARD CHARLIE | 26.0417% | 150 | 150 | 26.041667 | 0.000000 | 2,385,952 | 0 | 2,385,952 |
| 6,020 | ACE UP: 6 CARD CHARLIE | 19.9336% | 1,200 | 1,000 | 18.611296 | 3.322259 | 1,521,936 | 304,387 | 1,626,323 |
| 151,229 | ACE UP: 7 CARD CHARLIE | 9.2575% | 14,000 | 10,000 | 8.612488 | 2.644995 | 605,840 | 242,336 | 848,176 |
| 9,162,054 | ACE UP: 8/9 CARD CHARLIE | 9.1826% | 841,319 | 573,496 | 6.259470 | 2.923173 | 573,496 | 267,823 | 841,319 |
| | | | NET PRESENT VALUE 6% INTEREST RATE TOTAL VALUE 1457000 | NET PRESENT VALUE 6% INTEREST RATE TOTAL VALUE 1000000 | | | | | |
| | | 94.0011% | | | 85.110720 | 8.890427 | 7,797,890 | 814,546 | 8,612,436 |
| | | | | | | | | PROGRESSIVE HOLD ➤ | 6.00% |

NOTES

ODDS ARE CALCULATED FOR A SINGLE DECK OF 52 CARDS WHICH ARE RESHUFFLED AFTER EVERY DEAL.
BECAUSE A NINE CARD CHARLEY IS SO RARE, IT HAS BEEN COMBINED WITH THE EIGHT CARD CHARLEY.
THE TWO LOWEST PAYOFFS ARE NOT PROGRESSIVE, THAT IS, THEY ALWAYS PAY THE SAME AMOUNT.
THE EXPECTED PAYOFF IS CALCULATED BY USING THE ODDS OF WINNING AND BY USING THE SEED MONEY
IF THE EXPECTED PAYOFF REMAINS THE SAME THEN LOWERING THE SEED MONEY FORCES THE PROGRESSIVE MONEY NEEDED TO GO UP THEREBY CAUSING THE METER TO SPIN FASTER. (A POSITIVE RESULT)
HOWEVER, LOWERING THE SEED MONEY IS UNTO ITSELF A NEGATIVE RESULT ( CHOOSING THE CORRECT SEED IS AN ART FORM)
MORE SEED MONEY CAN BE COLLECTED THAN NECESSARY, THIS HAPPENS WHEN THE ACTUAL PAYOFF EXCEEDS THE EXPECTED PAYOFF, SOMETIMES LESS SEED MONEY THAN NECESSARY WILL BE COLLECTED
THE LARGEST PROGRESSIVE JACKPOT WILL BE PAID OUT OVER TWENTY YEARS AS AN ANNUITY, THEREFORE THE ACTUAL COST IS A NET PRESENT VALUE CALCULATION ( USING 6% AS THE INTEREST RATE)

Fig. 29C

100 HANDS PER HOUR - BET ONLY WHEN PLAYER HAS ADVANTAGE

| | SIMULATION RESULT FOR PLAYER | % OF HANDS WITH PLAYER ADVANTAGE | AVERAGE ADVANTAGE | UNITS PER TOTAL HANDS (u/th) | EIGHT DECK ESTIMATED WINNINGS/HR IF $50 BET | SIX DECK ESTIMATED WINNINGS/HR IF $25 BET |
|---|---|---|---|---|---|---|
| | | | 50% PENETRATION | | | |
| 17 | -4.51% | 6.99% | 1.38% | 0.000965 | $5.00 | $4.00 |
| 18 | -5.16% | 2.24% | 2.02% | 0.000452 | $2.50 | $2.00 |
| 19 | -5.52% | 2.25% | 1.86% | 0.000419 | $2.00 | $2.00 |
| 20 | -6.74% | 2.96% | 1.95% | 0.000577 | $3.00 | $3.00 |
| 21 | -8.72% | 1.26% | 2.86% | 0.000360 | $2.00 | $2.00 |
| | | | 55% PENETRATION | | | |
| 17 | -4.54% | 8.20% | 1.57% | 0.001287 | $6.50 | $5.50 |
| 18 | -5.08% | 2.99% | 2.48% | 0.000742 | $3.50 | $3.50 |
| 19 | -5.63% | 2.96% | 1.83% | 0.000542 | $2.50 | $2.50 |
| 20 | -6.82% | 3.76% | 2.37% | 0.000891 | $4.50 | $4.00 |
| 21 | -8.66% | 1.81% | 3.38% | 0.000612 | $3.00 | $3.00 |
| | | | 60% PENETRATION | | | |
| 17 | -4.53% | 9.39% | 1.84% | 0.001728 | $8.50 | $6.50 |
| 18 | -5.08% | 3.79% | 2.42% | 0.000917 | $4.50 | $4.50 |
| 19 | -6.56% | 3.79% | 2.14% | 0.000811 | $4.00 | $3.00 |
| 20 | -6.84% | 4.67% | 2.54% | 0.001186 | $6.00 | $4.50 |
| 21 | -8.65% | 2.46% | 2.57% | 0.000632 | $3.00 | $3.00 |
| | | | 65% PENETRATION | | | |
| 17 | -4.48% | 10.55% | 2.14% | 0.002258 | $11.50 | $7.50 |
| 18 | -5.07% | 4.66% | 2.83% | 0.001319 | $6.50 | $4.50 |
| 19 | -5.57% | 4.65% | 2.32% | 0.001079 | $5.50 | $4.00 |
| 20 | -6.85% | 3.86% | 3.90% | 0.001505 | $7.50 | $5.50 |
| 21 | -8.70% | 3.19% | 3.48% | 0.001110 | $5.50 | $4.00 |
| | | | 70% PENETRATION | | | |
| 17 | -4.54% | 11.72% | 2.20% | 0.002578 | $13.00 | $9.50 |
| 18 | -5.12% | 5.59% | 3.01% | 0.001683 | $8.50 | $6.50 |
| 19 | -5.59% | 5.55% | 2.65% | 0.001471 | $7.50 | $5.63 |
| 20 | -6.88% | 4.73% | 3.93% | 0.001859 | $9.50 | $7.00 |
| 21 | -8.66% | 4.01% | 4.21% | 0.001688 | $8.50 | $6.50 |
| | | | 75% PENETRATION | | | |
| 17 | -4.53% | 12.79% | 2.52% | 0.003223 | $16.00 | $12.00 |
| 18 | -5.10% | 6.54% | 3.28% | 0.002145 | $10.50 | $8.00 |
| 19 | -5.60% | 6.52% | 2.78% | 0.001813 | $9.00 | $8.00 |
| 20 | -6.82% | 7.63% | 3.28% | 0.002503 | $12.50 | $10.00 |
| 21 | -8.69% | 4.86% | 4.66% | 0.002265 | $11.50 | $8.00 |

Fig. 30

| | | |
|---|---|---|
| 20<br>3:1 | 21<br>6:1 | BUST<br>2:1 |
| 39:1 ACE | 9:1 ACE | 14:1 ACE |
| 100+ BONUS | 100+ BONUS | 100+ BONUS |
| 17<br>5:1 | 18<br>5:1 | 19<br>5:1 |
| 19:1 ACE | 24:1 ACE | 29:1 ACE |
| 100+ BONUS | 100+ BONUS | 100+ BONUS |

METHOD OF PLAYING A MODIFIED TWENTY-ONE CARD GAME

RELATED APPLICATIONS

This application claims priority from U.S. provisional patent application Ser. No. 60/034,058, filed on Jan. 8, 1997, incorporated herein by reference.

This application is related to, and incorporates by reference, the following applications: provisional patent application Ser. No. 60/019,747, filed Jun. 14, 1996 entitled "PICK 'EM POKER TOURNAMENT GAME AND INTERACTIVE NETWORK COMPUTER SYSTEM FOR IMPLEMENTING SAME" and U.S. patent application Ser. No. 08/716,114, filed Sep. 19, 1996 entitled "PICK 'EM POKER CARD/TOURNAMENT GAME AND INTERACTIVE NETWORK COMPUTER SYSTEM FOR IMPLEMENTING SAME," provisional patent application Ser. No. 60/011,574, filed Feb. 13, 1996 entitled "INTERACTIVE NETWORK GAMBLING CASINO SYSTEM," and U.S. patent application Ser. No. 08/747,800, filed Nov. 8, 1996 entitled "VIDEO POKER GOLD CARD GAME AND COMPUTER SYSTEM FOR IMPLEMENTING SAME."

BACKGROUND OF THE INVENTION

1. Field of the Invention

The present invention relates to a modified twenty-one or black jack card game, and more particularly, a modified twenty-one card game providing a player to wager on beating/losing to the dealer, as well as wagering on potential dealer outcomes.

2. Background of the Related Art

The growth of the gaming industry, in particular, gambling casinos has been very significant over the last decade. The industry has come to recognize the need for new games and new gambling concepts. It also recognizes that the new technologies available need to be integrated in order to improve their gaming environment. It also recognizes the need to become a more efficient gaming provider.

The state gaming control boards of Nevada and New Jersey (which have traditionally been slow to approve any new games or gambling concepts) have changed their philosophy so dramatically that today they actively encourage the trial and acceptance of new games and gambling concepts. The problem with introducing new games has always been the basic criteria for mass-market gambling:

Easy-to-learn game rules.

Strategies must be easy to master and not favor "the expert" disproportionately.

Games must have a short duration between the start (the bet) and the finish (the payoff).

The payoff structure, that is, what can be won by a lucky player must be enticing.

The game must be fair, that is, the casino should not have an unreasonable advantage.

The game must be "secure", that is, protected from cheating and tampering.

The casino's "win" must be demonstrated to be worthwhile, that is, the "win per machine per month" must at least compare favorably to that of the "slots".

Over the years, there have been many different types of games that have attempted to satisfy the demands of the gaming industry. These games have ranged the gamut from those involving great mental prowess to games involving merely chance. Nevertheless, there is still a strong interest in game concepts that create real excitement.

One game of interest over the years is twenty-one or black jack. Various attempts have been made to enhance play of twenty-one over the years. Examples of such attempts are described in the following U.S. patent references, all of which are hereby incorporated by reference:

U.S. Pat. No. 5,174,579
U.S. Pat. No. 5,248,142
U.S. Pat. No. 5,257,810
U.S. Pat. No. 5,275,416
U.S. Pat. No. 5,280,915
U.S. Pat. No. 5,390,934
U.S. Pat. No. 5,395,119
U.S. Pat. No. 5,454,570
U.S. Pat. No. 5,494,296

However, all these prior art attempts at making the twenty-one game interesting and challenging have not been successful.

One example, is U.S. Pat. No. 5,174,579 to Griffiths, assigned to the assignee of the present application. In Griffiths, an additional separate wager is added to a conventional twenty-one game. The player wagers on whether the dealer will either bust, or achieve a hand count of exactly 21. The twenty-one game is played out according to the conventional method of play of the game, and the normal winning and losing hands are paid or collected by the dealer. The dealer then reconciles the additional separate wager based on whether the dealer has either busted or achieved a hand count of exactly 21 during the play of the dealer's hand. This additional wager can be paid according to predetermined odds, such as one-to-one odds or others, as determined by the house.

Griffiths provides a player an additional chance of winning a separate wager when the dealer has either achieved an unbeatable winning hand of twenty-one (similar to insurance when the dealer's first card up is an ace), or when the dealer busts (similar to the typical wager where the player bets he will beat the dealer or the dealer will bust). Unfortunately, this additional wager is not very exciting because the predetermined odds are one-to-one, and the like. That it, the additional wager in Griffiths is unable to mathematically embrace the appropriate odds to make the additional wager of interest.

On the other hand, we have determined that a more natural method and game of twenty-one is possible. We have further discovered that it is desirable to provide a more interesting and exciting game of twenty-one.

We have further discovered that it is desirable to provide a more interesting game of twenty-one that entices players to make additional wagers, thereby maximizing casino earnings.

We have also discovered that it is desirable to provide a more interesting game of twenty-one that provides the feature of guaranteeing at least one win when the player makes all possible wagers.

We have also discovered that it is desirable to provide a more interesting game of twenty-one that provides the feature of enhanced or high payoffs for more excitement.

We have further discovered that it is desirable to provide a more interesting game of twenty-one that provides additional wagers that are extremely fast to make, thereby increasing the number of wagers possible in a game or during a predetermined time interval of play.

We have further discovered that it is desirable to provide a more interesting game of twenty-one that provides multiple wagers that are extremely fast to make, thereby increasing the number of wagers that may be placed simultaneously.

We have further discovered that it is desirable to provide a more interesting game of twenty-one that provides enhanced payoffs, such as a jackpot or a progressive jackpot.

SUMMARY OF THE INVENTION

It is a feature and advantage of the present invention to provide a natural method and game of twenty-one.

It is another feature and advantage of the present invention to provide a more interesting and exciting game of twenty-one, or a modified black jack game.

It is another feature and advantage of the present invention to provide a more interesting game of twenty-one that entices players to make additional wagers, thereby maximizing casino earnings.

It is another feature and advantage of the present invention to provide a more interesting game of twenty-one that provides the feature of guaranteeing at least one win when the player makes all possible wagers.

It is another feature and advantage of the present invention to provide a more interesting game of twenty-one that provides the feature of enhanced or high payoffs for more excitement.

It is another feature and advantage of the present invention to provide a more interesting game of twenty-one that provides additional wagers that are extremely fast to make, thereby increasing the number of wagers possible in a game or during a predetermined time interval of play.

It is another feature and advantage of the present invention to provide a more interesting game of twenty-one that provides multiple wagers that are extremely fast to make, thereby increasing the number of wagers that may be placed simultaneously.

The present invention is based, in part, on the discovery that excitement of the twenty-one game can be greatly increased when players are permitted to wager not only on their own hand, but also on all possible dealer outcomes for the twenty-one game. The present invention is also based, in part, on the discovery that a more interesting game of twenty-one is possible that provides enhanced payoffs, such as a jackpot or a progressive jackpot.

We have also discovered that excitement for the twenty-one game is greatly enhanced when the player has the opportunity to wager on dealer outcomes, either in the regular play of the game, or in a jackpot or progressive jackpot context.

The modified black jack card game side or additional bet is totally independent of the player's strategy and expectation for the main bet. Against an average player, the house advantage for the modified black jack card game side bets ranges from roughly 4.5% to 8.5%. There is also beneficially little reason to tie the main bet to the side bet in any way. That is, the player may be given the option to make a wager on the main bet alone, any of the side bets alone, or a combination of main and side bets. Further, the above bets are not inconsistent with each other, requiring opposing or contradicting strategies.

Absent any special constraints, proficient card-counters can profit from the modified black jack card game side bets. However, the introduction of elementary procedural limitations appears sufficient to efficaciously counter these efforts. These possibilities include, for example,: 1) capping each of the side bets 17–21 at $25 for a 6-deck shoe and $50 for an 8-deck shoe (the Bust side bet need not be capped at all); or alternatively, 2) limiting the pack penetration to roughly 50% for a 6- or 8-deck shoe. Other obvious constraints can also be placed on the modified black jack card game, such as altering odds, limiting payoffs, and the like.

To achieve the features and advantages of the present invention, a method of playing a modified twenty-one card game by at least a dealer is provided. The method includes the steps of placing a wager awarded when the player bets that the dealer will score at least one of a predetermined number of dealer outcomes, and playing the twenty-one game. The method also includes the steps of determining the score of the dealer, and comparing the score of the dealer to the predetermined number of dealer outcomes bet by the player. The player is awarded responsive to the wager and a coincidence between the dealer score and one of the predetermined number of dealer outcomes.

These together with other objects and advantages which will be subsequently apparent, reside in the details of construction and operation as more fully herein described and claimed, with reference being had to the accompanying drawings forming a part hereof wherein like numerals refer to like elements throughout.

BRIEF DESCRIPTION OF THE DRAWINGS

FIGS. 2A–2G are illustrations of exemplary payoff tables according to the first embodiment of the modified game of twenty-one;

FIG. 14B is an illustration of an exemplary payoff table according to the fourth embodiment of the modified game of twenty-one;

FIGS. 29A–29C are tables illustrating alternate payoffs for this progressive feature of the modified black jack game;

FIG. 30 for a summary table of penetration analysis and potential winnings for the modified black jack game;

DESCRIPTION OF THE PREFERRED EMBODIMENT OF THE INVENTION

Figure 1A:
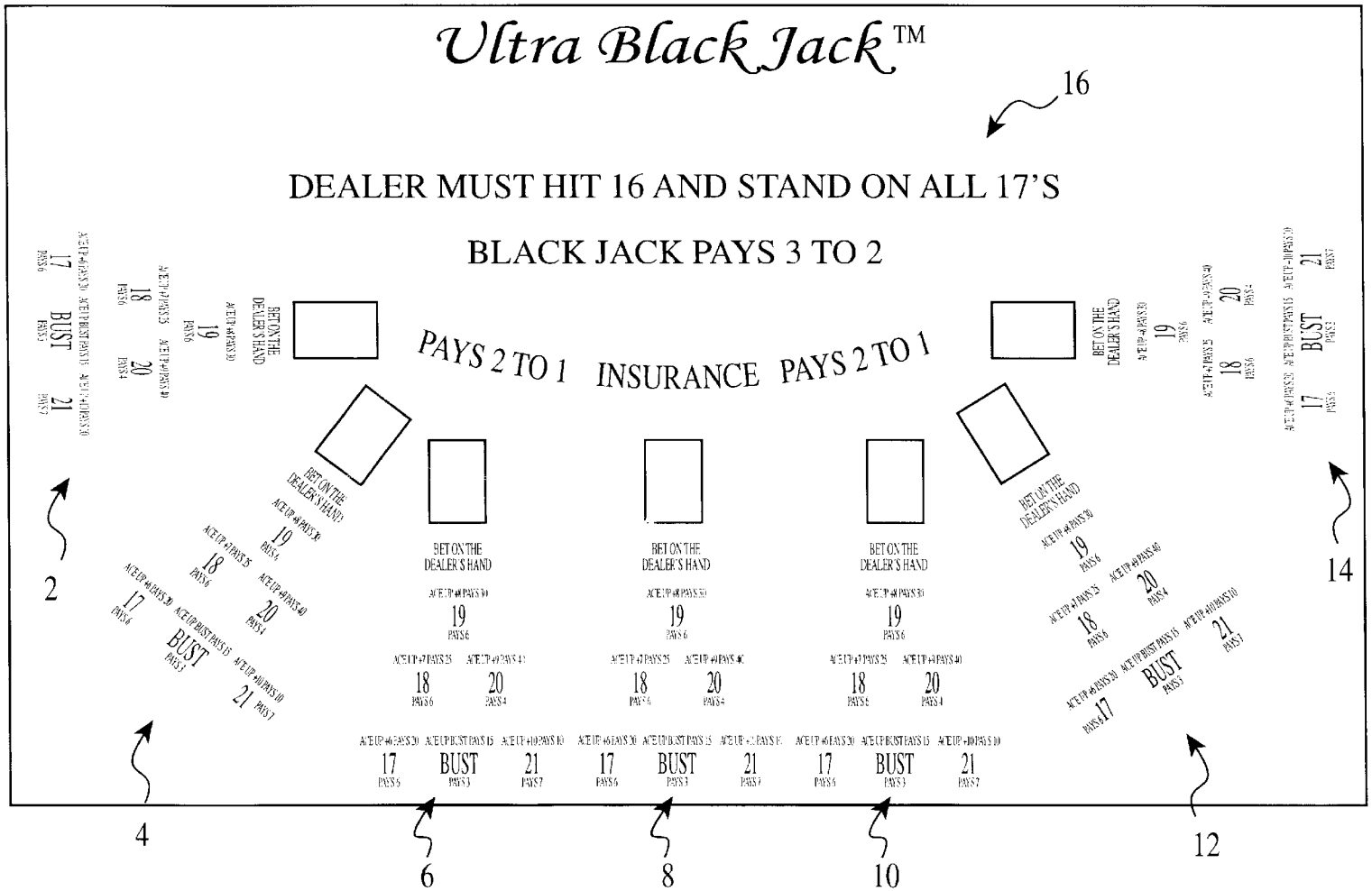
FIG. 1A is an illustration of a first embodiment of the modified game of twenty-one designed for table play.

The present invention is based, in part, on the discovery that excitement of the twenty-one game can be greatly increased when players are permitted to wager not only on their own hand, but also on all possible dealer outcomes for the twenty-one game. The present invention is also based, in part, on the discovery that a more interesting game of twenty-one is possible that provides enhanced payoffs, such as a jackpot or a progressive jackpot.

We have also discovered that excitement for the twenty-one game is greatly enhanced when the player has the opportunity to wager on dealer outcomes, either in the regular play of the game, or in a jackpot or progressive jackpot context.

The modified twenty-one or black jack game is a casino table game, for example, for a dealer and 1 to 7 players. It can also be played as an individual video casino game. It contains at least two unique features:

1) A special modified black jack game payoff table which encourages the player to place additional wagers on the Dealer's hand. These wagers are independent of the normal Black jack wagering, and therefore, do not effect the normal Black Jack strategy.
2) Each modified black jack game bet has been subdivided into two levels of payoffs, the commonly occurring level with odds ranging from, for example, (2 to 1) to (6 to 1), and the Ace Up Level (the dealer's up card has to be an Ace) with odds ranging from, for example, (10 to 1) to (40 to 1).

The Game Device is a standard felt-covered table, similar to a Black Jack table with a special play-and-bet design, stenciled onto the felt, in front of each player, or a video gaming device, with, for example, five numbered buttons (17, 18, 19, 20 & 21), one bust button, and the other buttons necessary to play normal Black Jack.

Basic Rules the Game

1) Players place their bets—of which there are two types:
a) The normal Black Jack bet.
b) The modified black jack game bet(s) (on what outcomes/cards the Dealer will have)
2) The Dealer deals a normal round of Black Jack.
3) If the Players at the table Bust (go over 21), or have a natural Black Jack (an Ace with a Ten or Picture card), then contrary to standard play where there would be no reason for the Dealer to take any cards—here the Dealer must proceed to take cards (i.e., as he normally would if any Player has been left in an undetermined status). This allows for the modified black jack game bets to be determined.
4) The Dealer pays off all normal Black Jack bets and also all modified black jack game bets.

Detailed Rules of Game

When the player normally places the standard bet, the player is betting that he/she is going to beat the dealer. The player loses if he/she busts, or has a lower number than the dealer. It does not matter in the regular game of black jack if the dealer busts because the player has already lost. In this particular game of modified black jack game, a totally independent action (i.e., a totally independent bet) is made that has nothing to do with the regular bet. That is, the player can bet that the dealer will finish with 17, 18, 19, 20 or 21 or bust.

For the modified black jack game, the normal rules of black jack apply, but in addition, the player may bet that the dealer ends up or finishes with a 17, 18, 19, 20, 21 or bust. Each of these possibilities are mandatory dealer results because the dealer must hit on anything lower than 17. The dealer is going to end up with any of those 5 final totals, 17–21 or bust. The player can bet on any one or more of the dealer results, in addition to, or even instead of betting on beating the dealer.

The player can therefore protect himself, and bet on some of the possible winning numbers of the dealer. Thus, at the time the player places the first bet, the player also gets to bet on the dealer results 17, 18, 19, 20, 21 or dealer bust.

FIG. 1A illustrates the table layout of the modified black jack game. In FIG. 1A, the table layout includes player positions 2, 4, 6, 8, 10, 12, and 14. Of course, any number of players may be included in the modified twenty-one game, subject to the limitation on the number of cards in the deck(s). Area 16 on the table includes various indicia providing collateral or additional rules, such as payoffs for player black jack (3:2), standard insurance payoffs (2:1), and the like.

Figure 1B:
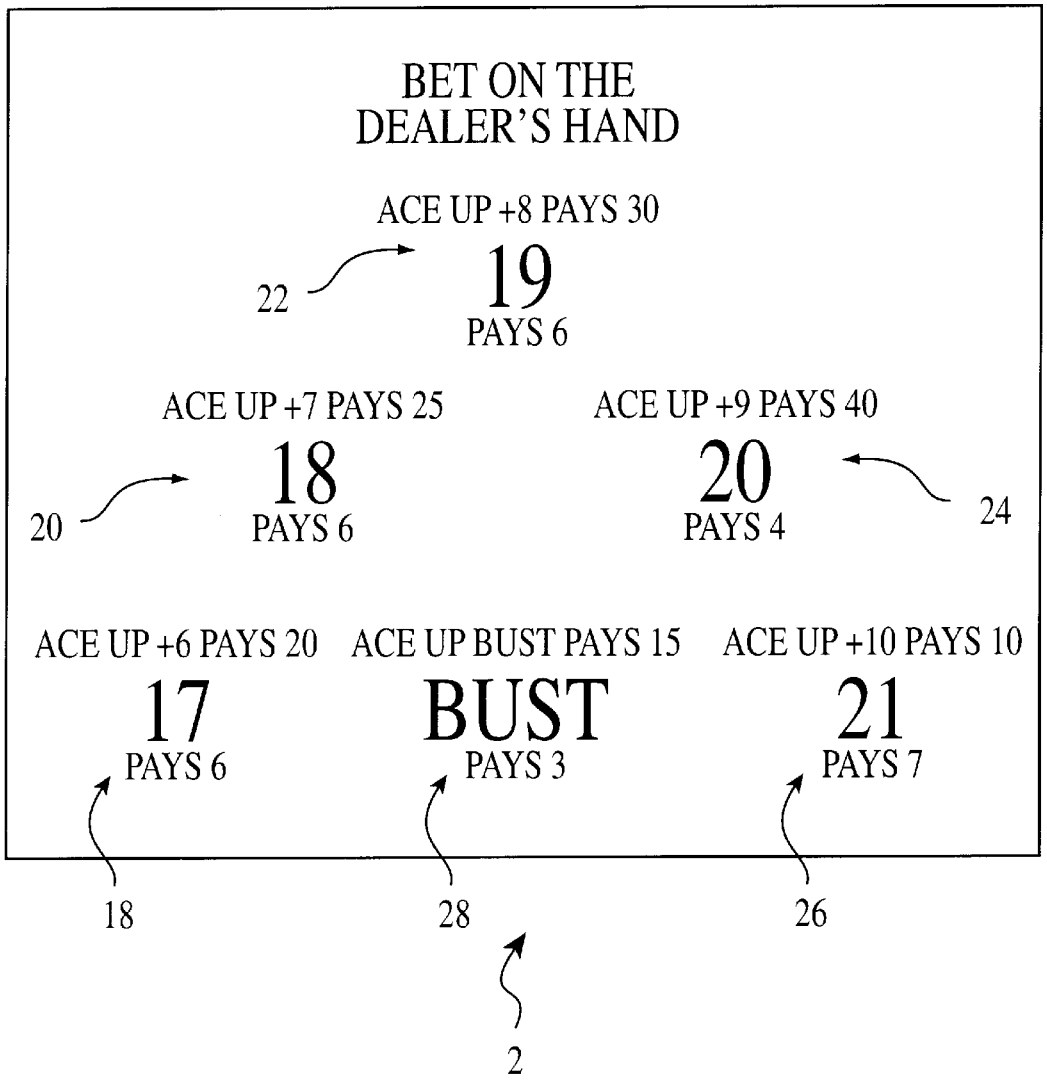
FIG. 1B is an enlarged illustration of player station for the first embodiment of the modified game of twenty-one.

FIG. 1B illustrates an enlarged view of the table layout of the modified black jack game for an individual player. In FIG. 1B, player position 2 includes individual dealer bet areas 18 (for dealer 17), 20 (for dealer 18), 22 (for dealer 19), 24 (for dealer 20), 26 (for dealer 21), and 28 (for dealer bust). Note that player position 2 is designed in a pyramidal or triangular shape to facilitate wagering. Each wager position includes the odds or rate of return for the wager.

Advantageously, these odds have been separated or divided into odds designed for the dealer obtaining a hand of 17, 18, 19, 20, 21 or bust with any card combination, and an enhanced payoff when the dealer achieves a hand of 17, 18, 19, 20, 21 or bust with a predetermined combination of cards. In this example, the predetermined combination requires the dealer to have an ace card first, and then the remaining cards to form the hand of 17, 18, 19, 20, 21 or bust. Of course, other predetermined card combinations could be used to provide the enhanced payoffs for the modified black jack game. The significant aspect of this feature of the modified black jack game is that enhanced payoffs are provided for dealer hands that match a predetermined card combination. Thus, various card combinations can be used, and which are contemplated by the present invention.

If the player bets the dealer will lose, the special modified black jack game bet makes no difference or is unaffected with respect to what the player does in connection with this bet. The player can win or lose; it does not make any difference because the modified black jack game bet is an independent action.

The payoffs are as follows: For example, if the player bets 17, 18 or 19, he gets 5 to 1, i.e., a total of 6. For 20, the player gets a total of 4, or 3 to 1, for 21 the player gets 6 to 1 or a total of 7, and for bust the player gets 2 to 1 or a total of 3. There are 16–10 cards in the deck, so the number 20 comes up more often, and therefore, the player only gets 3 to 1 odds. Thus, the dealer has a better chance of getting a 20 than a 17, 18, 19 or 21.

See FIGS. 2A–2G for a listing of the different payoffs. FIG. 2A is an illustration of an exemplary payoff table for the modified game of twenty-one where the odds have been determined based on a combination of six decks of cards. FIGS. 2B–2G is an alternative payoff table according to the modified game of twenty-one. These payoff tables are the same, with the exception of the Casino's hold, depending on the number of decks, and card playing strategy. For example, FIG. 2B is for playing the modified black jack game with six decks (similar results for 4 or 8 decks as well), and FIG. 2C is the same as FIG. 2B, but with taking into consideration a player using a card counting strategy to maximize the chances of winning. Both FIGS. 2B and 2C also require the dealer to stand on any card hand 17 or higher, and are based on running simulations for one million deals.

FIG. 2D is for playing the modified black jack game with six decks (similar results for 4 or 8 decks as well), and FIG. 2E is the same as FIG. 2D, but with taking into consideration a player using a card counting strategy to maximize the chances of winning. Both FIGS. 2D and 2E also allow the dealer to hit on the standard soft 17 and the dealer must stand on other card combinations of 17 or higher. FIGS. 2D and 2E are based on running simulations for one million deals.

FIG. 2F is for playing the modified black jack game with only one card deck, and FIG. 2G is the same as FIG. 2F, but with taking into consideration a player using a card counting strategy to maximize the chances of winning. Both FIGS. 2F and 2G require the dealer to stand on all card combinations of 17 or higher. FIGS. 2F and 2G are based on running simulations for one million deals.

As will be discussed below, the payoffs/returns include the ability to fine tune the hold or the take of the game operator, such as a casino, using, for example, the special payoff/return when the dealer has an ace +6for the number 17, an ace +7 for the number 18, an ace +8 for the number 19 or an ace +9 for the number 20.

The player can also protect certain numbers by picking them off by betting on them and so protect or recover his original wager even though he loses to the dealer including his original wager. For example, if the player winds up with number 18 and the dealer gets 20, the player can recover his initial wager if the player also made a modified black jack game wager on 20. If the player bet $10 to win and $5 on 20, the player winds up winning $10 in total because he won $20 from the modified black jack game bet and lost $10 on the initial wager or regular black jack bet.

The modified black jack game includes the advantage that it is totally independent of the regular modified black jack game, as well as totally independent of player actions. Thus, there is no strategy conflict or a player cannot increase their chances of winning by playing to bust, and the like. The reason is that the player is betting on dealer performance, and the dealer has no control over what he does. He must stick on 17 or higher, and must take another card on 16 or lower.

As illustrated in FIG. 1, the modified black jack game can be played at any standard black jack table and does not affect the basic game of black jack. People do not have to play the modified black jack game wager or even the regular wager if they place the modified black jack game wager. As indicated above, modified black jack game is a variation of black jack without any conflict with the existing black jack game rules.

The modified black jack game may also be played on a stand alone computer or a computer in a network environment. See the different patent applications that have been incorporated by reference.

Advantageously, the modified black jack game includes the ability to fine tune the hold for the game operator/casino. By jiggling or modifying the return for the modified black jack game for the special return of ace +6, 7, 8 or 9 combination, payoffs can be fine tuned at 98%, 94%, 96%, and the like. Thus, one of the essential features of the modified black jack game is that the casino hold can be fine tuned with ease. This is very important to the casino.

As illustrated in FIG. 1, the casino hold is 5%. Thus, although 12 to 1 is offered for 17 for an ace and a 6 and a 6 to 1 otherwise, by changing the 12 to 1 to a 15 to 1 (as well as the other ace +7, 8 or 9) the casino hold is now changed to 2%, from 5% previously. Thus, if an additional 3 to 1 is added to the ace +6, 7, 8 and 9 returns, the overall chances are 98%, and the casino keeps 2%. In addition, an additional 3 to 1 may be subtracted from each of the ace +6, 7, 8, and 9 returns resulting in a total hold of 8%.

On the other hand, if the returns for the basic 17, 18, 19 and 20 dealer hands are changed, by 3, the overall affect is between 18–20%. Therefore, it is extremely important to properly adjust the hold easily and effectively.

Thus, the modified black jack game provides higher payoffs than other black jack type games. For example, when players buy insurance for dealer black jack, the player is normally only getting 2 to 1 odds. However, the modified black jack game pays much higher as illustrated in FIGS. 1A, 1B, and 2. As discussed, FIG. 2 is a payoff table that has specific advantages in terms of percentage of hold versus odds or payoff provided the player.

Another reason for the advantage of this fine tuning of the probabilities feature is that it allows the creation of even odds on the bets. Otherwise, without the fine tuning feature, the odds would likely be more like 5 to 2, 9 to 2, 13 to 5, which may be very confusing to the players. The use of even odds advantageously eliminates all this potential confusion.

A further advantage of the modified black jack game, design is that it prevent collusion among the players. That is, the modified black jack game extends the concept of making secondary bets to making secondary bets on the dealer performance. Thus, the dealer performance is unrelated to and does not affect the player's strategy of playing the game. Whether the dealer obtains a 17, 18, 19, 20, 21 or bust, with or without an ace, is irrelevant to the player's strategy because the dealer must do every time the same thing. The dealer has any choices at all because the dealer must take a card on any hand of 16 or lower, and must stick on any hand 17 or higher.

Figure 3:
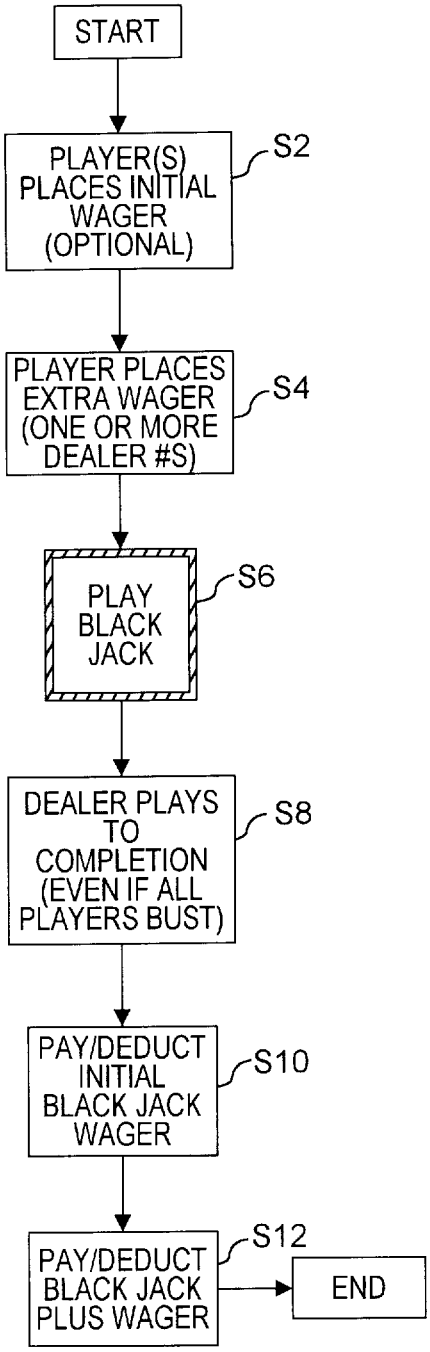
FIG. 3 is an illustration of the basic game rules/procedure for playing the modified game of twenty-one.
Figure 4:
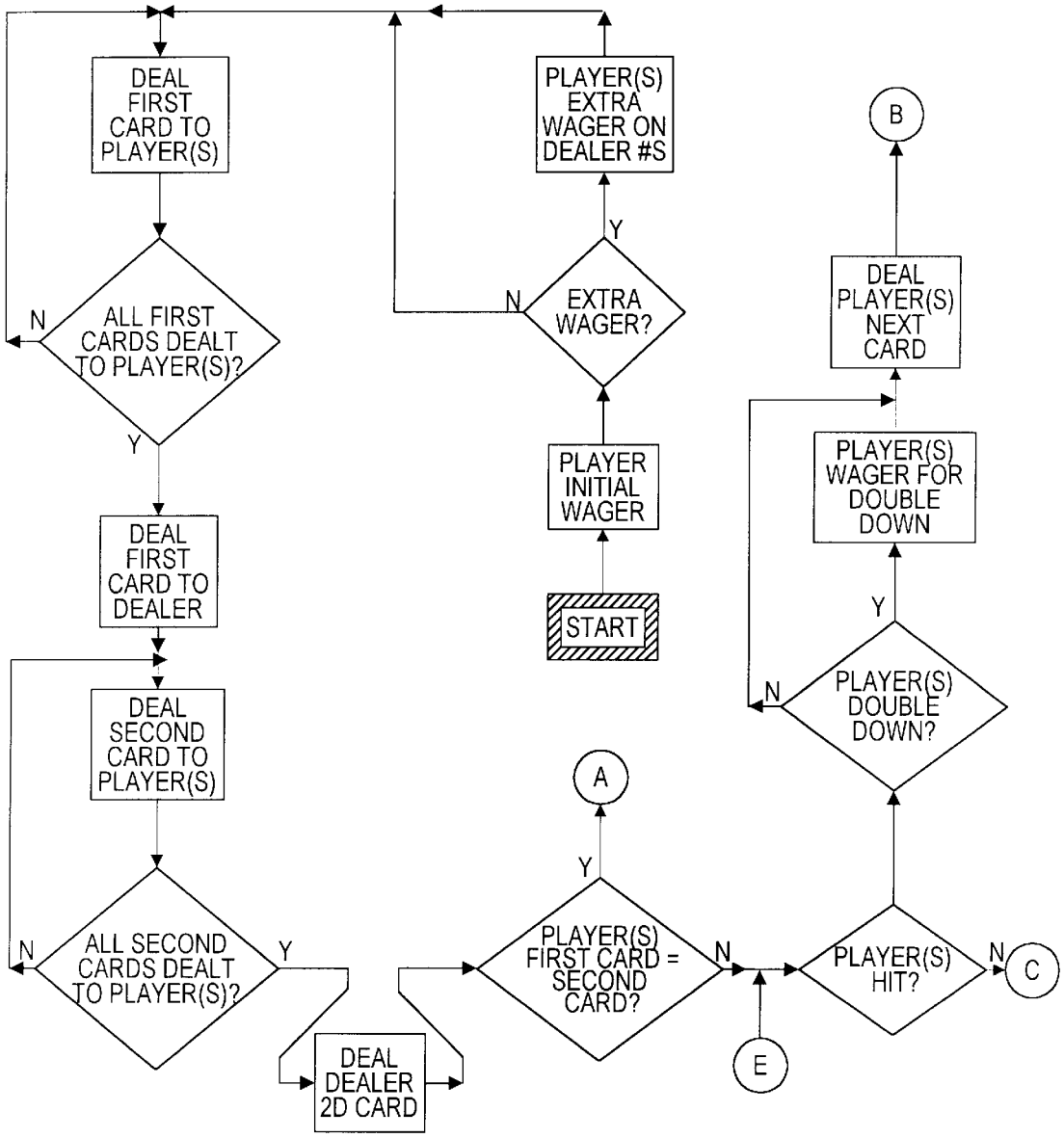
FIGS. 4–7 are detailed flow charts illustrating the detailed process/rules for playing the modified game of twenty-one.
Figure 5:
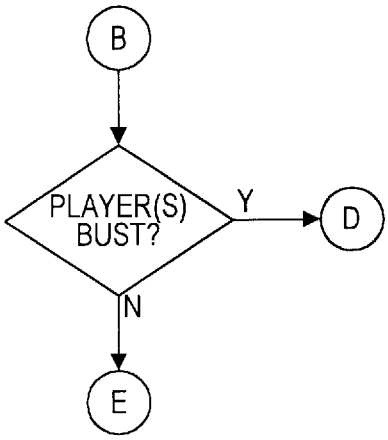

FIG. 3 is an illustration of the basic game rules/procedure for playing the modified black jack game. In FIG. 3, the game begins with the player optionally making the initial wager for playing the basic black jack game in step S2. Next, the player is also asked whether the player wants to make the additional modified black jack game wager on one or more of 17, 18, 19, 20, 21 or bust in step S4. Next, the regular game of black jack is played in step S6. The dealer next plays to completion, even though all the players may have busted and lost their initial wager to ensure that the dealer has the results needed for scoring for the modified black jack game wager in step S8.

The player hands are compared to the dealer hands to determine the winners for the initial wager in step S10. Next, the dealer's hand is compared to the player's modified black jack game wager in step S12. Step S12 also includes evaluating the dealer's hand to determine whether the dealer got a 17, 18, 19, 20, 21 or bust with an ace and other card and also to determine whether the player is eligible to receive an enhanced payoff. The modified black jack game bet places that have been bet on or scored are then determined with respect to the appropriate player, and compared to the dealer's final hand. The player's that have won are then awarded the appropriate reward.

FIGS. 4–7 are detailed flow charts illustrating the basic process/rules of the modified black jack game. FIGS. 4–7 detail rules relating to splitting hands, doubling down, wagering for basic game of twenty-one, and wagering for the modified black jack or twenty-one game.

Figure 8A:
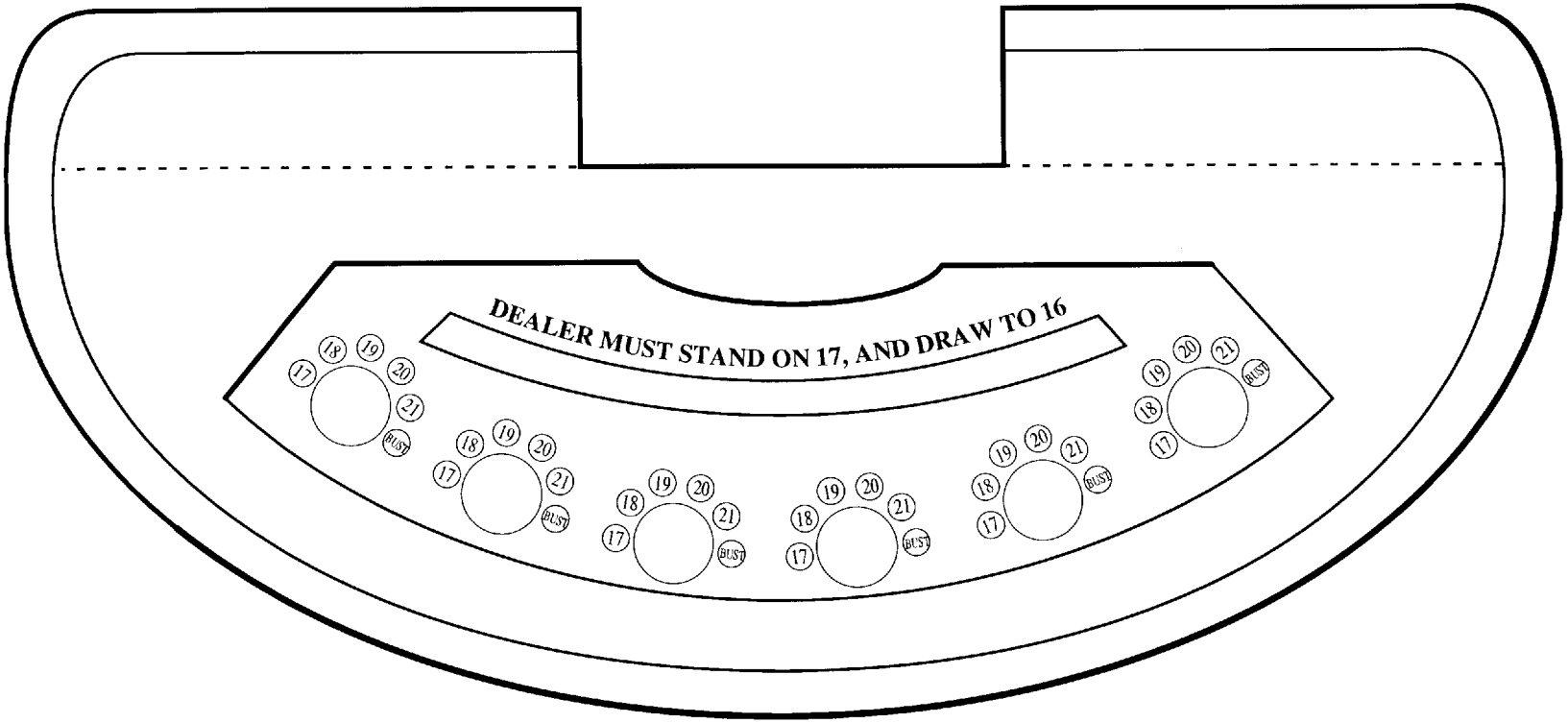
FIG. 8A is an illustration of a second embodiment of the modified game of twenty-one designed for table play.
Figure 8B:
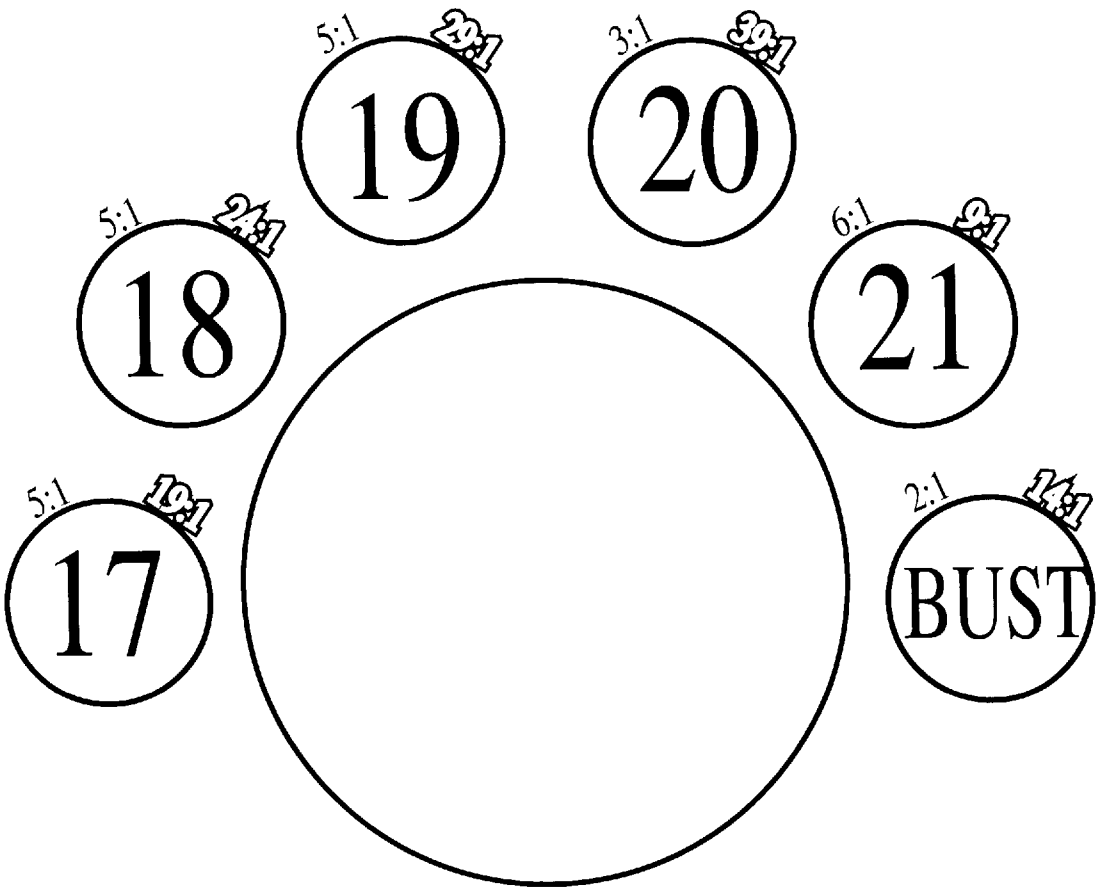
FIG. 8B is an enlarged illustration of player station for the second embodiment of the modified game of twenty-one.

FIG. 8A is an illustration of a second embodiment of the modified game of twenty-one designed for table play, and FIG. 8B is an enlarged illustration of player station for the second embodiment of the modified game of twenty-one. In accordance with this second embodiment, the modified black jack wagers are placed in positions 17, 18, 19, 20, 21 or bust that are disposed around the player position in a semi-circle. This allows easy access by the player, as well as the house or casino, for placing, awarding and removing wagers from the table.

Figure 9:
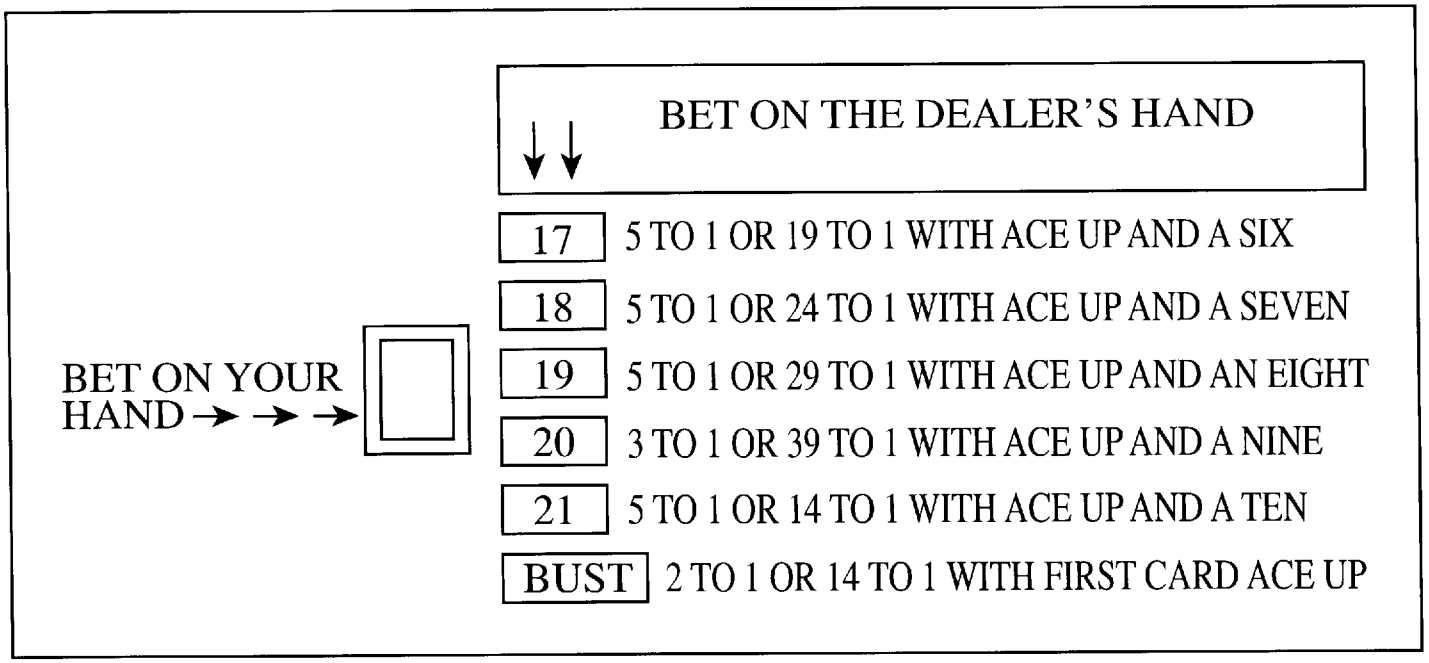
FIG. 9 is an illustration of a third embodiment of the modified game of twenty-one designed for table play.

FIG. 9 is an illustration of a third embodiment of the modified game of twenty-one designed for table play. In accordance with this third embodiment, the modified black jack wagers are placed in positions 17, 18, 19, 20, 21 or bust that are disposed in the player position in a vertical orientation. This allows easy access by the player, as well as the house or casino, for placing, awarding and removing wagers from the table.

Figure 10:
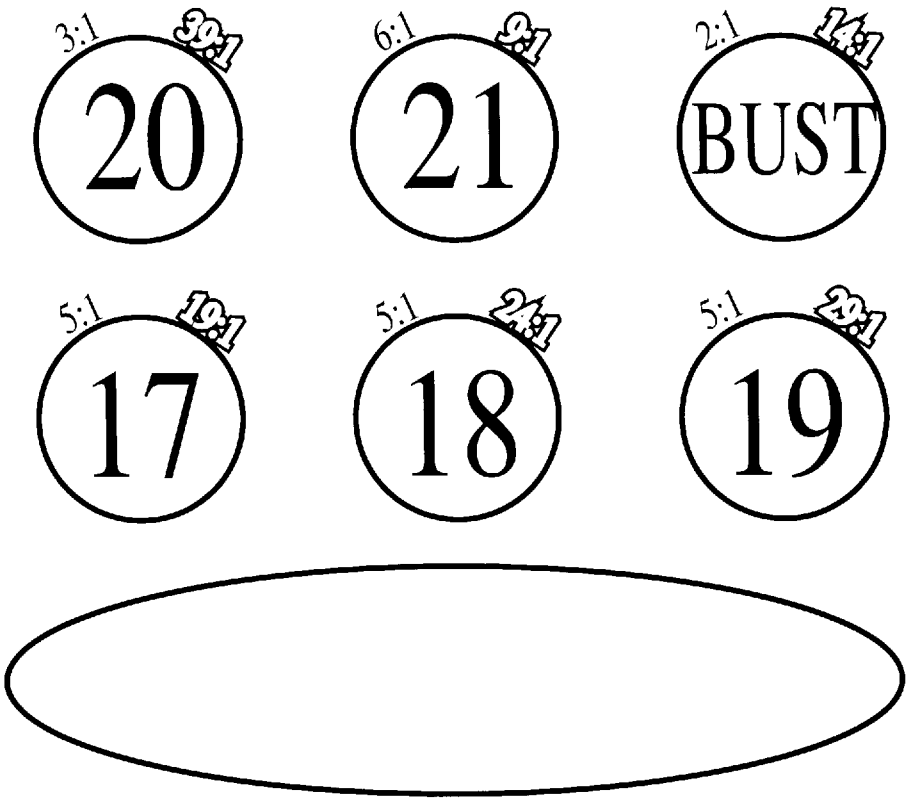
FIG. 10 is an illustration of a fourth embodiment of the modified game of twenty-one designed for table play.

FIG. 10 is an illustration of a fourth embodiment of the modified game of twenty-one designed for table play. In accordance with this fourth embodiment, the modified black jack wagers are placed in positions 17, 18, 19, 20, 21 or bust that are disposed in the player position in a row/column orientation. This also permits easy access by the player, as well as the house or casino, for placing, awarding and removing wagers from the table. Note that the large oval at the bottom of FIG. 10 represents the location for betting on the standard game of twenty-one.

Figure 11:
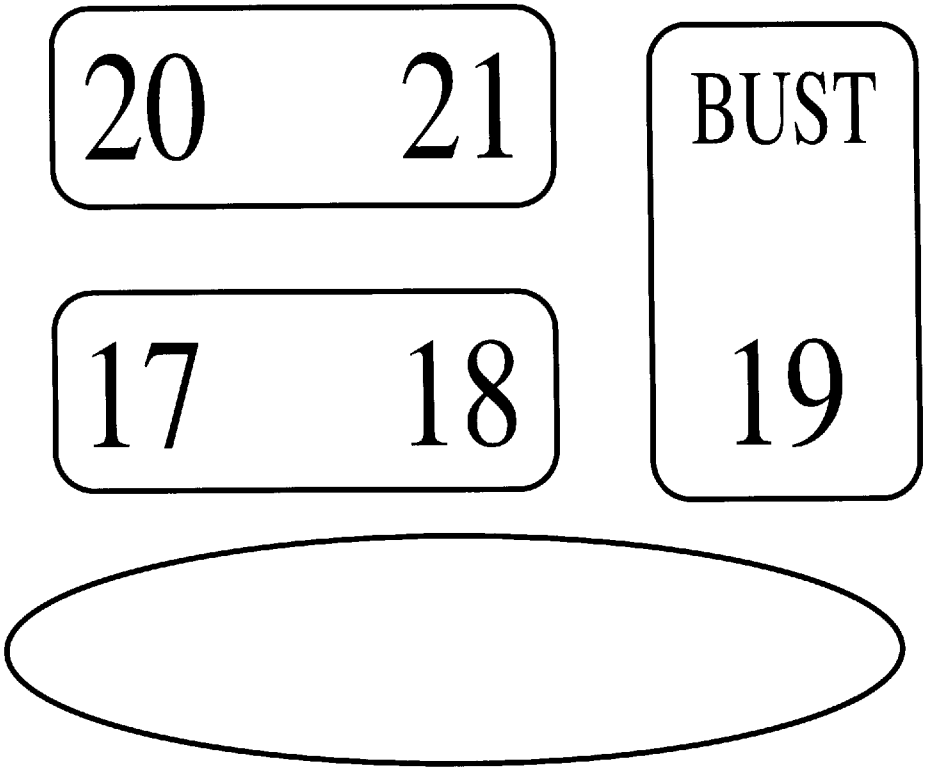
FIG. 11 is an illustration of a fifth embodiment of the modified game of twenty-one designed for table play.

FIG. 11 is an illustration of a fifth embodiment of the modified game of twenty-one designed for table play. In accordance with this fifth embodiment, the combined modified black jack wagers are placed in positions 17–18, 19-bust, and/or 20–21 that are disposed in the player position in a row/column orientation. Suitable odds may also be provided for this option of the modified black jack wager. Importantly, while this fifth embodiment combined different dealer outcomes, the player is still permitted to bet on one, a plurality or all possible dealer outcomes.

This orientation illustrated in FIG. 11 permits easy access by the player, as well as the house or casino, for placing, awarding and removing wagers from the table. Note that the large oval at the bottom of FIG. 11 represents the location for betting on the standard game of twenty-one.

Figure 12:
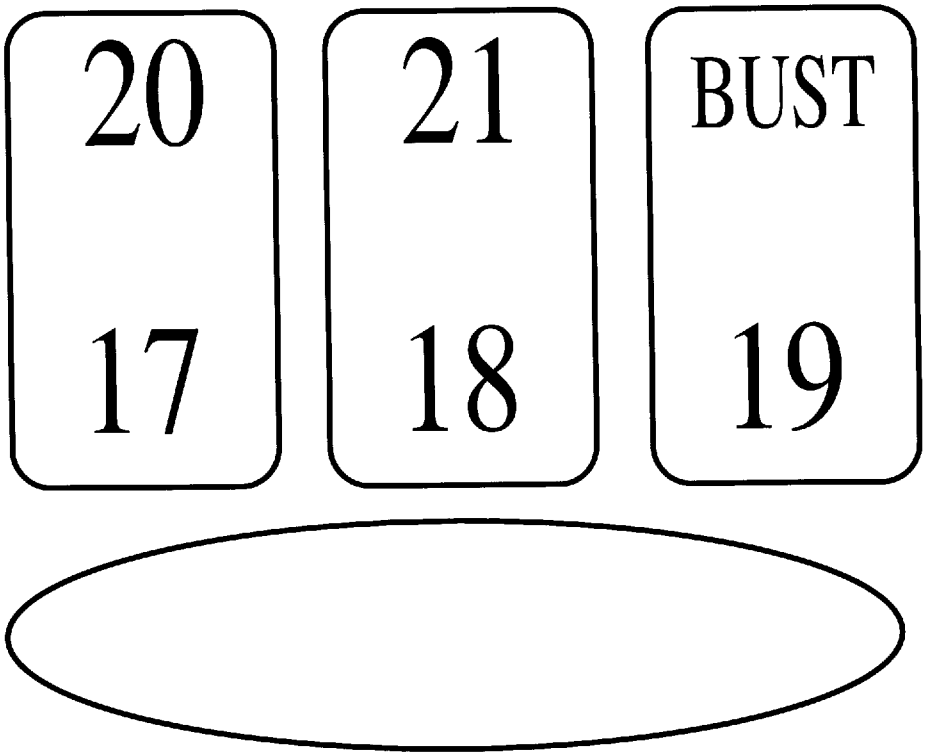
FIG. 12 is an illustration of a sixth embodiment of the modified game of twenty-one designed for table play.

FIG. 12 is an illustration of a sixth embodiment of the modified game of twenty-one designed for table play. In accordance with this sixth embodiment, the combined modified black jack wagers are placed in positions 17–20, 18–21, and/or 19-bust that are disposed in the player position in a column orientation. Suitable odds may also be provided for this option of the modified black jack wager. Importantly, while this sixth embodiment combined different dealer outcomes, the player is still permitted to bet on one, a plurality or all possible dealer outcomes.

This orientation illustrated in FIG. 12 permits easy access by the player, as well as the house or casino, for placing, awarding and removing wagers from the table. Note that the large oval at the bottom of FIG. 12 represents the location for betting on the standard game of twenty-one.

Figure 13:
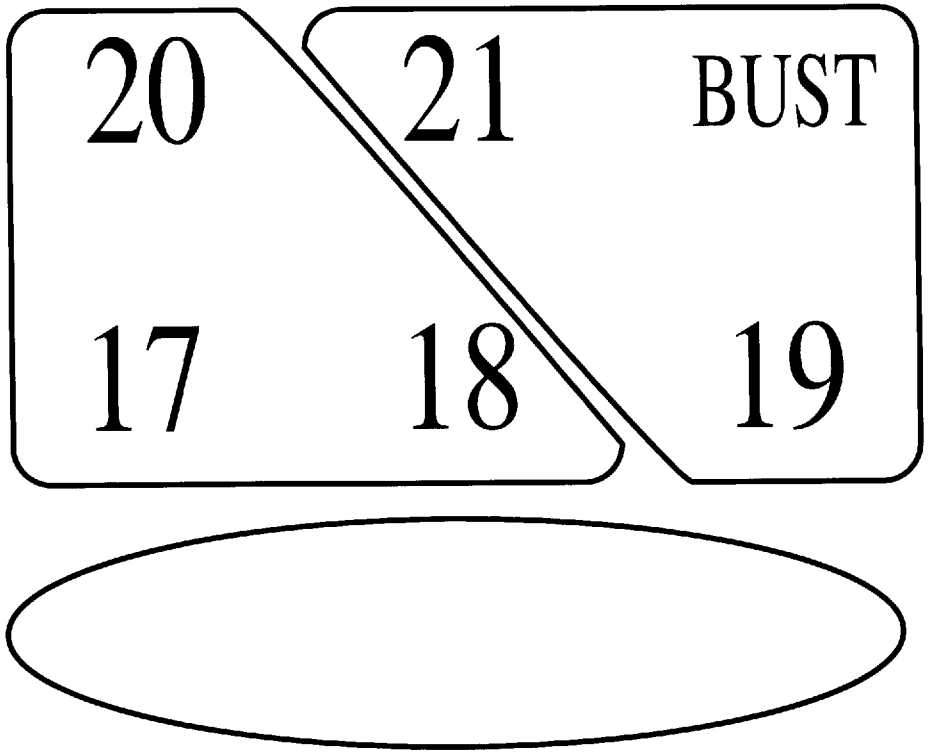
FIG. 13 is an illustration of a seventh embodiment of the modified game of twenty-one designed for table play.

FIG. 13 is an illustration of a seventh embodiment of the modified game of twenty-one designed for table play. In accordance with this seventh embodiment, the combined modified black jack wagers are placed in positions 17–18–20, and/or 19–21-bust that are disposed in the player position in a triangular orientation. Suitable odds may also be provided for this option of the modified black jack wager. Importantly, while this seventh embodiment combined different dealer outcomes, the player is still permitted to bet on one, a plurality or all possible dealer outcomes.

This orientation illustrated in FIG. 13 permits easy access by the player, as well as the house or casino, for placing, awarding and removing wagers from the table. Note that the large oval at the bottom of FIG. 13 represents the location for betting on the standard game of twenty-one.

Figure 14A:
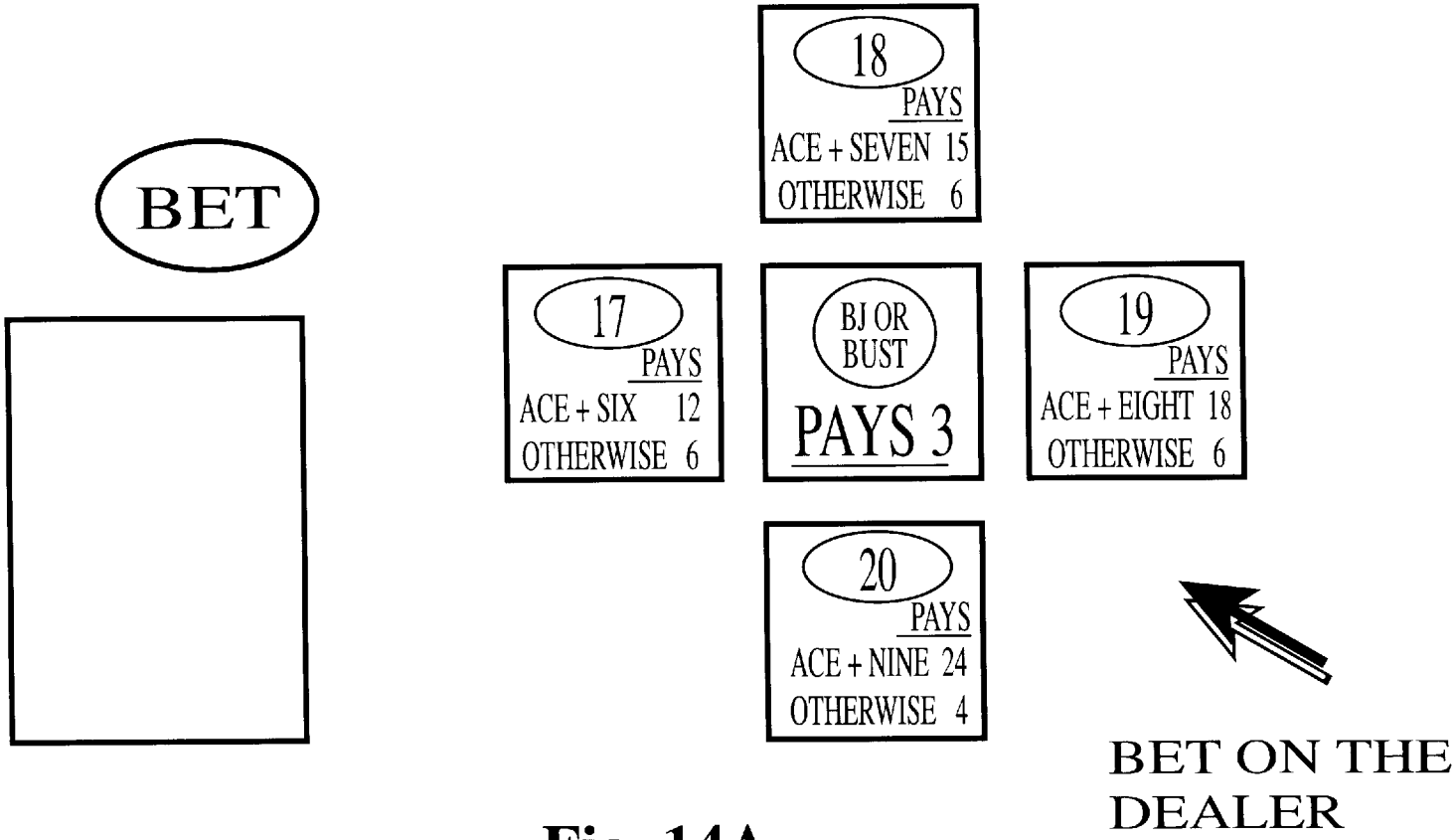
FIG. 14A is an illustration of an eighth embodiment of the modified game of twenty-one designed for table play.

FIG. 14A is an illustration of an eighth embodiment of the modified game of twenty-one designed for table play, and FIG. 14B is an illustration of an exemplary payoff table according to the fourth embodiment of the modified game of twenty-one. In accordance with this third embodiment, the modified black jack wagers are placed in positions 17, 18, 19, 20, and black jack or bust that are disposed in the player position in an "X" shaped orientation. This allows easy access by the player, as well as the house or casino, for placing, awarding and removing wagers from the table.

In this embodiment, the black jack or bust area indicates the requirement of ace and any card with a value of 10 to win on this position for the black jack. If the dealer gets 21 via the black jack, the player wins if he bets on the area indicating dealer bust or black jack. On the other hand, if the dealer gets a 21 using 3–7s, or other means besides black jack, then the player loses. This is called the sweeper. Like double zero on the craps table. All the chips are swept off. Thus, this fourth embodiment includes varied positions for playing the modified black jack game, including the feature of providing the casino with a "sweeper" feature or card hand. Note the alternative payoff table used in this embodiment of the modified black jack game.

Wagering on the modified black jack card game side bets, either individually or cumulatively, does not affect the player's strategy or expectation for the main or standard black jack wager. The converse is also true, namely that in the long run, the dealer's final distribution of hand totals (or, the outcome of the modified black jack card game side wagers) will be independent of any particular player's style of play.

Furthermore, no pattern of betting on the modified black jack card game bets will affect the outcome of the main game. The modified black jack card game bets are merely wagers on the dealer's final outcome, which is arrived at via an objective set of hitting/standing decisions, and therefore cannot be modified by the player's betting style.

To further improve the odds for the casino, the following options are possible for the modified black jack card game:

(1) Tying side bet to main bet:

The rules of the modified black jack card game such that the side bet can be no more than the main bet, and furthermore, the main bet must always be made at the time a side wager is made.

A good basic strategy player will net, on average, 0.005 units per hand for a typical 6 or 8 deck game. Therefore, the optimal strategy for a single card-counter is to again bet small (or nothing) with a side-bet disadvantage and raise both wagers simultaneously with the advantage.

We look at the limit in which the ratio of main wagers (with no side bet advantage) to main side wagers (with advantage) is 0. That is, we are jumping up both main and side bets with the advantage. Looking again at the modified black jack card game 17 side bet for 8 decks and 75% penetration, we find that 6.54% of the time, we have an advantage greater than 1%, and when we are favored, our average expectation is +4.48%. Therefore:

$$\text{Earnings}=100\times0.0654\times(\$100\times-0.005)+(\$100\times0.0448)=\$26/\text{hr}.$$

We see that, in general, tying the side wager to the main bet has some minor effect, since the expectation from the side wager, when profitable, overwhelms the slightly negative primary wager. Note also the similarity in card tags for the 17, 18 and 19 wagers.

(2) More decks:

We may increase the number of decks in use, as a means to thwart card-counting efforts. Comparing the results above, we find that converting a 6-deck 75% penetration game to an 8-deck 75% penetration game decreases the card-counter's earnings by only about 25%.

(3) Limiting Penetration:

It can be seen from the data above that limiting the penetration will also deter card-counters. For example, allowing the card-counter free reign in an 8-deck game with 75% penetration, he will earn roughly 5 times as much as the same game with only 50% penetration.

Relying on this technique, however, may be cause for concern, since dealers may be subject to err, and this would have very negative consequences. If penetration were always limited to 50% on an 8-deck shoe, then the caps on the maximum side bet allowed could be raised to approximately $200.

(4) Capping the side bet:

It appears that capping the 17, 18, 19, 20 and 21 side bets is a viable method of containing possible card-counting measures, provided the payoff table remains in the present form.

The impetus behind capping the side bet is to limit the amount of money that potential card-counters could earn from the game. In particular, the goal is simply to not make it worth their while.

Given a 6-deck game with 75% penetration, a maximum side wager of $25 would be possible. A single player, with nearly perfect play, would then realize profits of roughly $10/hr. Similarly, an 8-deck game with 75% penetration could have a maximum side wager of $50, which would earn a very-skilled player roughly $15/hr.

See FIG. 30 for a summary table of penetration analysis and potential winnings under these conditions. In this table, the 8-deck simulation results, given above, are again presented for ease of viewing. The final two columns show potential card-counter winnings (rounded to $0.50/hr): the 8-deck figures are derived directly from simulation data, and the 6-deck winnings are calculated via simulation and applicable extrapolations.

Recall however, that team play grows roughly as the square of the number of players. Forcing the above maximum limits on the side wagers (on a per wager basis, i.e., a player may make $25 wagers on each of 17, 19, 20 and 21 if so desired), suggests that a team of at least 3–4 people would be needed before earnings, per person, would approach $40/hr.

In any event, the side bet limits could be raised for certain players if requested, provided that management was aware that a particular player posed no risk. In so using the cap, there is the additional benefit that the side wager need not be tied to the main bet, as the main bet has little effect anyway. Players may wager only on the side bet(s) if they desire.

It is suggested that, in the 6-deck game, a limit of $25 per individual side bet (17, 18, 19, 20 or 21) be established. In an 8-deck game, this limit may be raised to $50. These caps are suggested under the assumption that the penetration is 75% in either case.

Players may wager on more than one side bet per hand, subject to the prevailing cap on each individual bet. Furthermore, subject to house desires, players need not make a main wager associated with the side bet.

The bust side bet need not be capped at all, subject to prevailing table limits of course. This wager is particularly difficult to bet via card-counting, primarily because no cards affect the expectation very much.

The implementation of betting caps would appear to be a sufficient detriment to card-counters. However, in the unlikely event that problems still persist, the limit could be lowered even further to quash card-counting endeavors.

(5) Additional Cut Card for Side Bet Wagers:

As an optional part of the shuffle, the dealer inserts a Red Cut Card at a predetermined penetration position in a 6- or 8-deck shoe. Just as the standard Yellow Cut Card cuts off any further deals until the next shuffle, the Red Cut Card demarcates the end of the modified black jack game side-betting until the next shuffle. A red mark on the side of the shoe can be used to indicate the nominal insertion point of the Red Card.

Provided that the penetration for the Red Card is adequately maintained, this simple solution allows for significantly higher caps for the side bets. For example, consider a $100 minimum 8-deck table utilizing a strictly enforced Red Card penetration of 50%. The side bet caps could then be raised to $200 while maintaining roughly the same level of safety as in the bet capping option.

Figure 15:
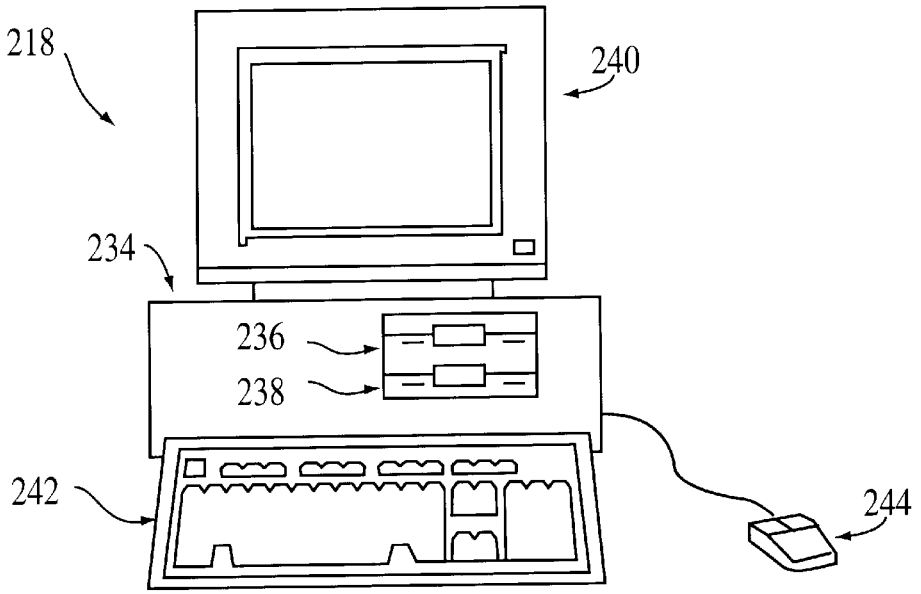
FIG. 15 is an illustration of main central processing unit for implementing the computer processing in accordance with the computer implemented stand-alone embodiment of the present invention.

FIG. 15 is an illustration of main central processing unit for implementing the computer processing in accordance with the computer implemented stand-alone embodiment of the present invention. The detailed descriptions, described above, may be presented in terms of program procedures executed on a computer or network of computers. These procedural descriptions and representations are the means used by those skilled in the art to most effectively convey the substance of their work to others skilled in the art.

A procedure is here, and generally, conceived to be a self-consistent sequence of steps leading to a desired result. These steps are those requiring physical manipulations of physical quantities. Usually, though not necessarily, these quantities take the form of electrical or magnetic signals capable of being stored, transferred, combined, compared and otherwise manipulated. It proves convenient at times, principally for reasons of common usage, to refer to these signals as bits, values, elements, symbols, characters, terms, numbers, or the like. It should be noted, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary, or desirable in most cases, in any of the operations described herein which form part of the present invention; the operations are machine operations. Useful machines for performing the operation of the present invention include general purpose digital computers or similar devices.

The present invention also relates to apparatus for performing these operations. This apparatus may be specially constructed for the required purpose or it may comprise a general purpose computer as selectively activated or reconfigured by a computer program stored in the computer. The procedures presented herein are not inherently related to a particular computer or other apparatus. Various general purpose machines may be used with programs written in accordance with the teachings herein, or it may prove more convenient to construct more specialized apparatus to perform the required method steps. The required structure for a variety of these machines will appear from the description given.

Figure 6:
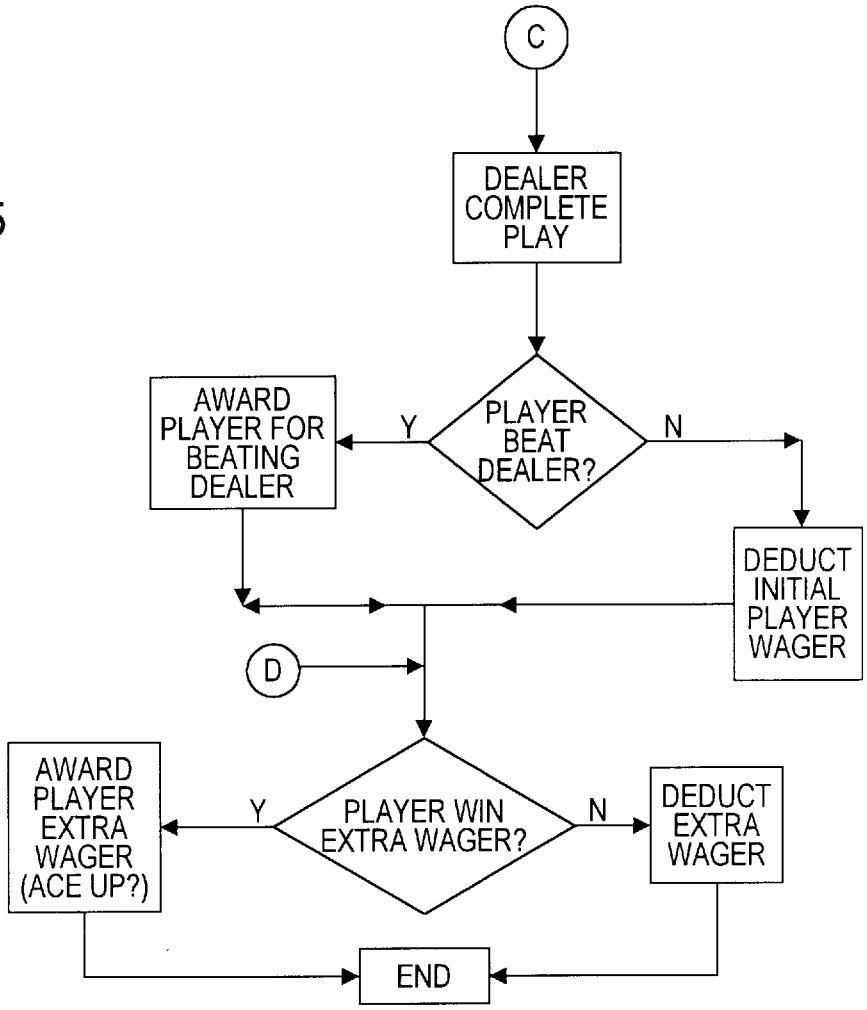

FIG. 15 is an illustration of main central processing unit 18 for implementing the computer processing in accordance with one embodiment of the present invention. In FIG. 6, computer system 218 includes central processing unit 234 having disk drives 236 and 238. Disk drive indications 236 and 238 are merely symbolic of the number of disk drives which might be accommodated in this computer system. Typically, these would include a floppy disk drive such as 236, a hard disk drive (not shown either internally or externally) and a CD ROM indicated by slot 238. The number and type of drives varies, typically with different computer configurations. The computer includes display 240 upon which information is displayed. A keyboard 242 and a mouse 244 are typically also available as input devices via a standard interface.

Figure 7:
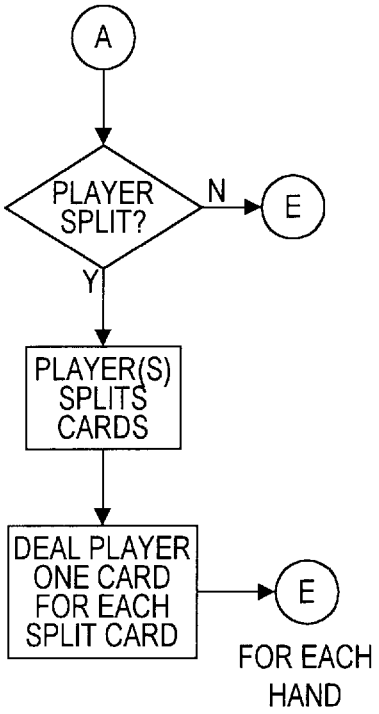
Figure 16:
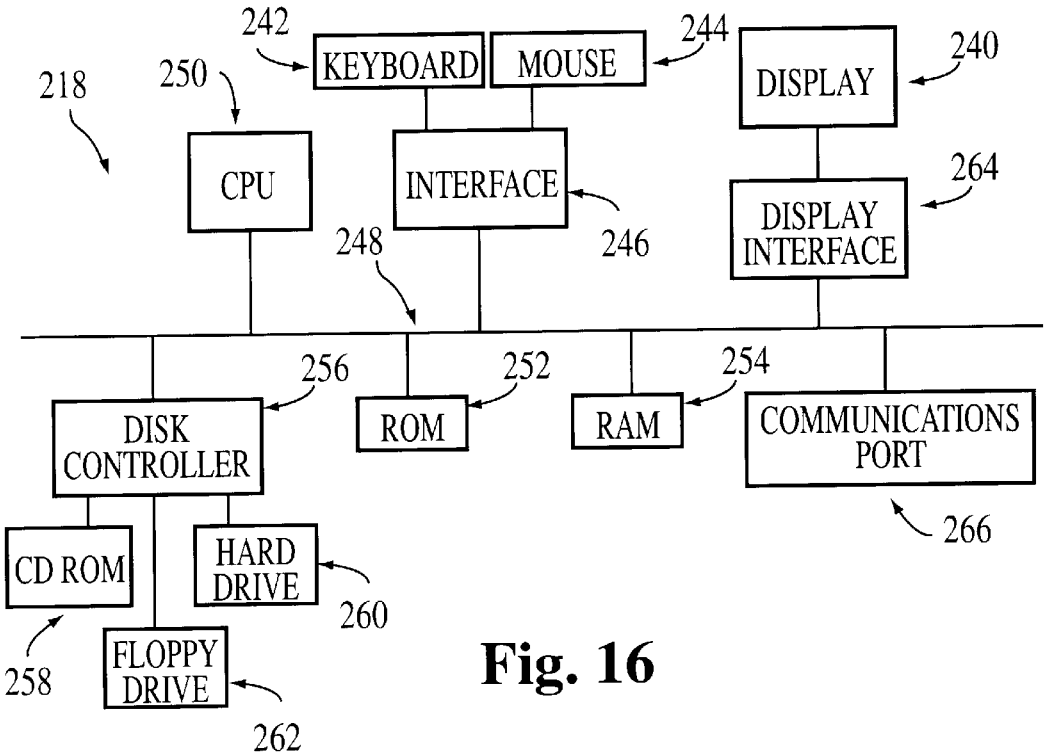
FIG. 16 is a block diagram of the internal hardware of the computer illustrated in FIG. 15.

FIG. 16 is a block diagram of the internal hardware of the computer 218 illustrated in FIG. 15. As illustrated in FIG. 7, data bus 248 serves as the main information highway interconnecting the other components of the computer system. Central processing units (CPU) 250 is the central processing unit of the system performing calculations and logic operations required to execute a program. Read-only memory 252 and random access memory 254 constitute the main memory of the computer, and may be used to store the simulation data.

Disk controller 256 interfaces one or more disk drives to the system bus 248. These disk drives may be floppy disk drives such as 262, internal or external hard drives such as 260, or CD ROM or DVD (digital video disks) drives such as 258. A display interface 264 interfaces with display 240 and permits information from the bus 248 to be displayed on the display 240. Communications with the external devices can occur on communications port 266.

Figure 17:
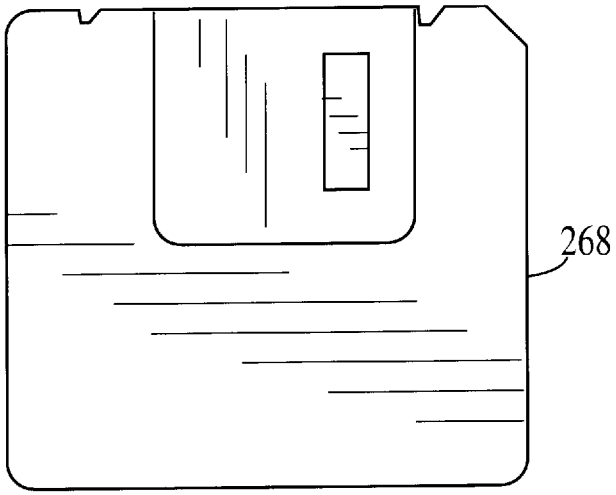
FIG. 17 is an illustration of an exemplary memory medium which can be used with disk drives illustrated in FIGS. 15–16.

FIG. 17 is an illustration of an exemplary memory medium which can be used with disk drives such as 262 in FIG. 16 or 236 in FIG. 15. Typically, memory media such as a floppy disk, or a CD ROM, or a digital video disk will contain, inter alia, the program information for, controlling the computer to enable the computer to perform the testing and development functions in accordance with the computer system described herein.

Figure 18:
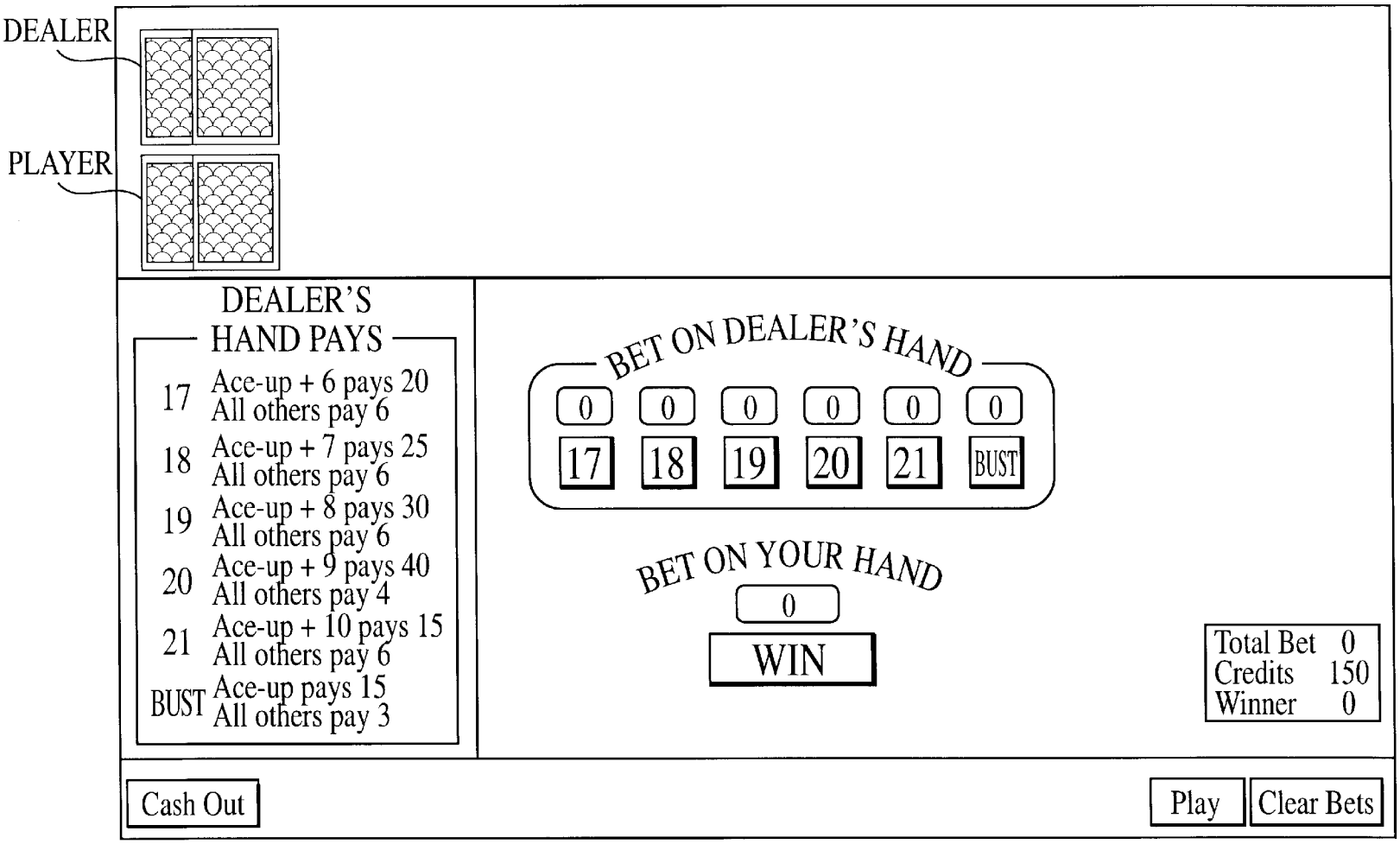
FIG. 18 is a screen display of the initial or starting screen for playing the modified game of twenty-one.
Figure 19:
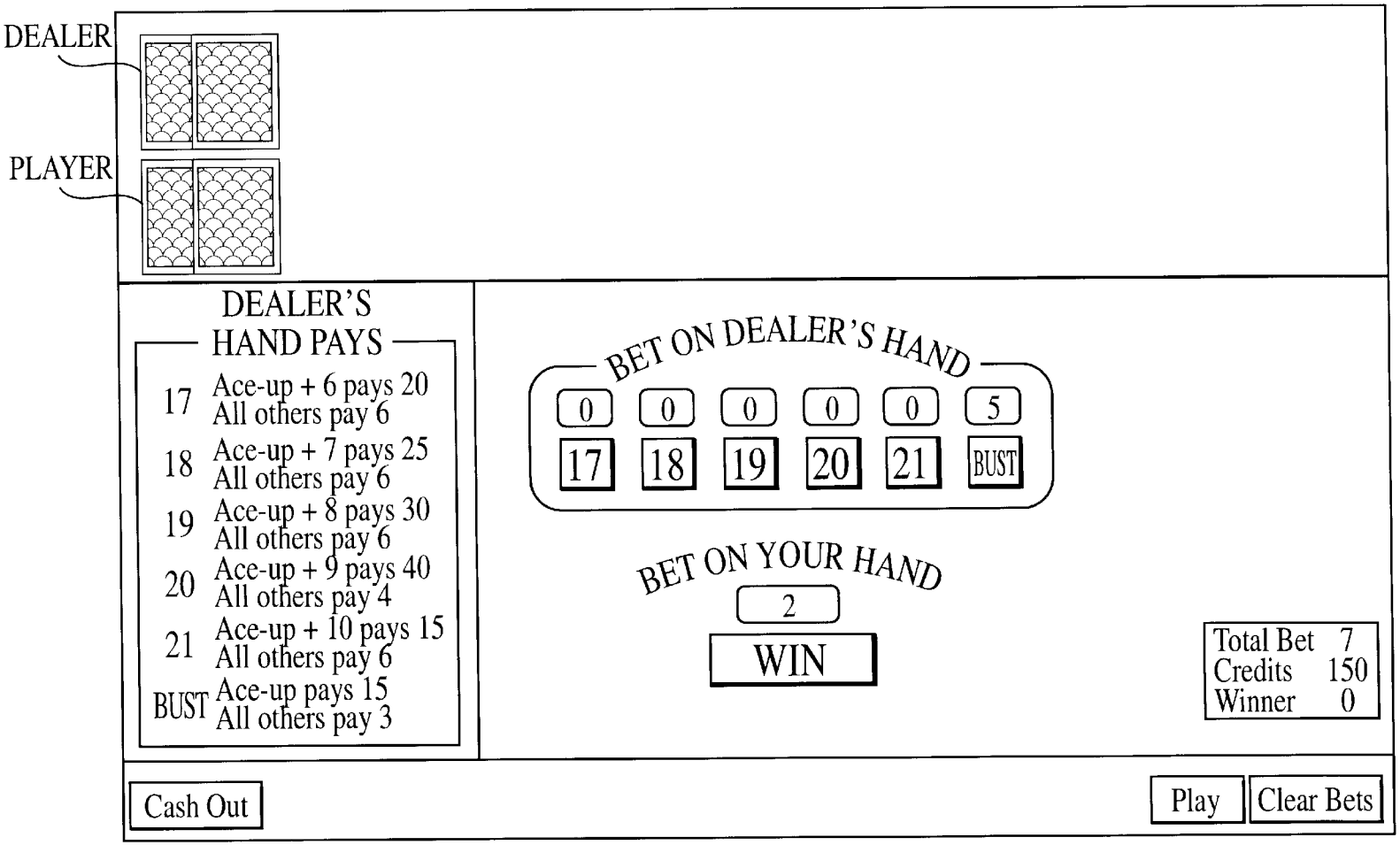
FIG. 19 is a screen display of when the player bets 2 credits on the regular black jack game, and 5 credits on the bust position in the modified game of twenty-one.
Figure 20:
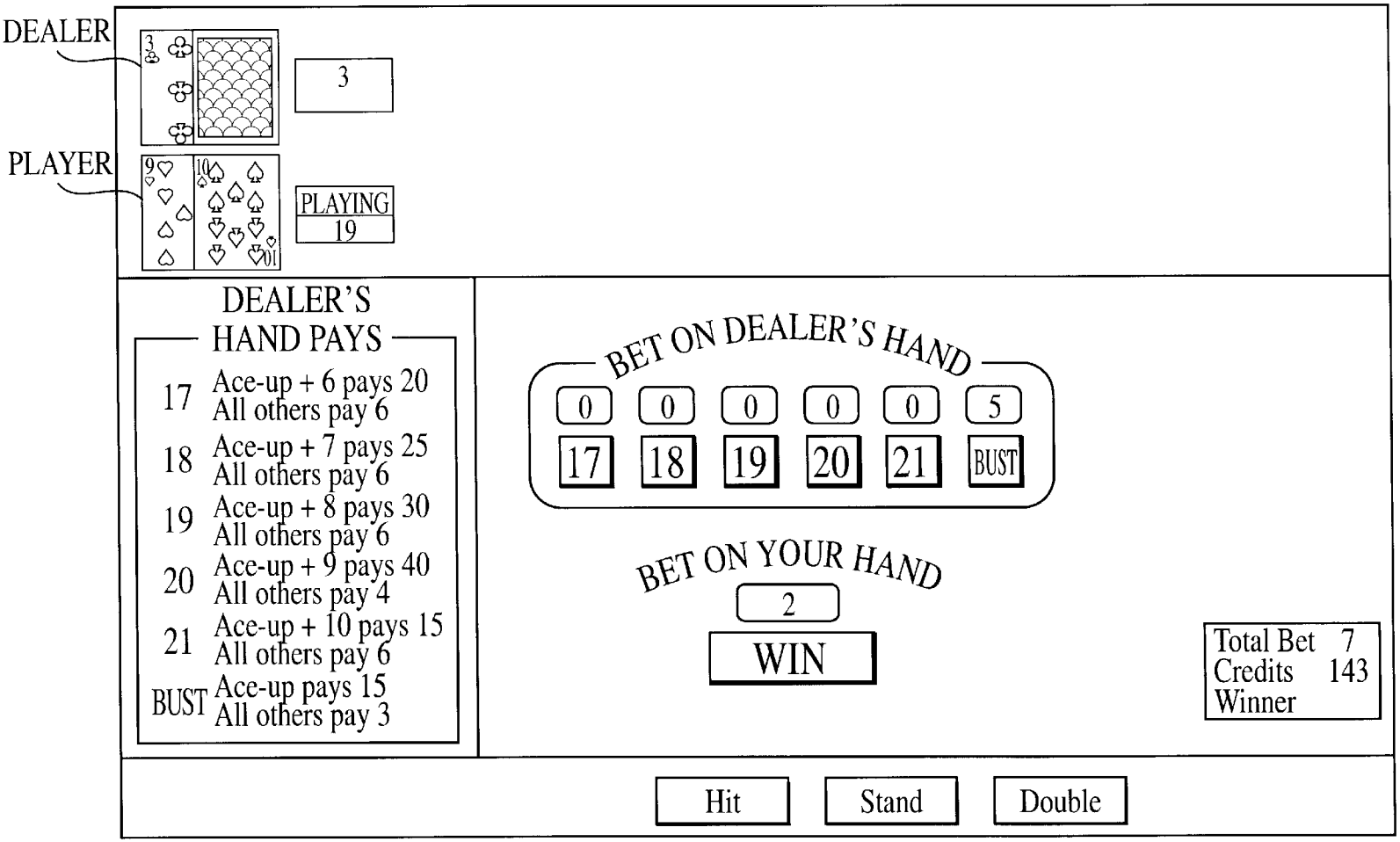
FIG. 20 is a screen display of when the player has received 19 points in accordance with the player's bets illustrated in FIG. 19 for playing the modified game of twenty-one.
Figure 21:
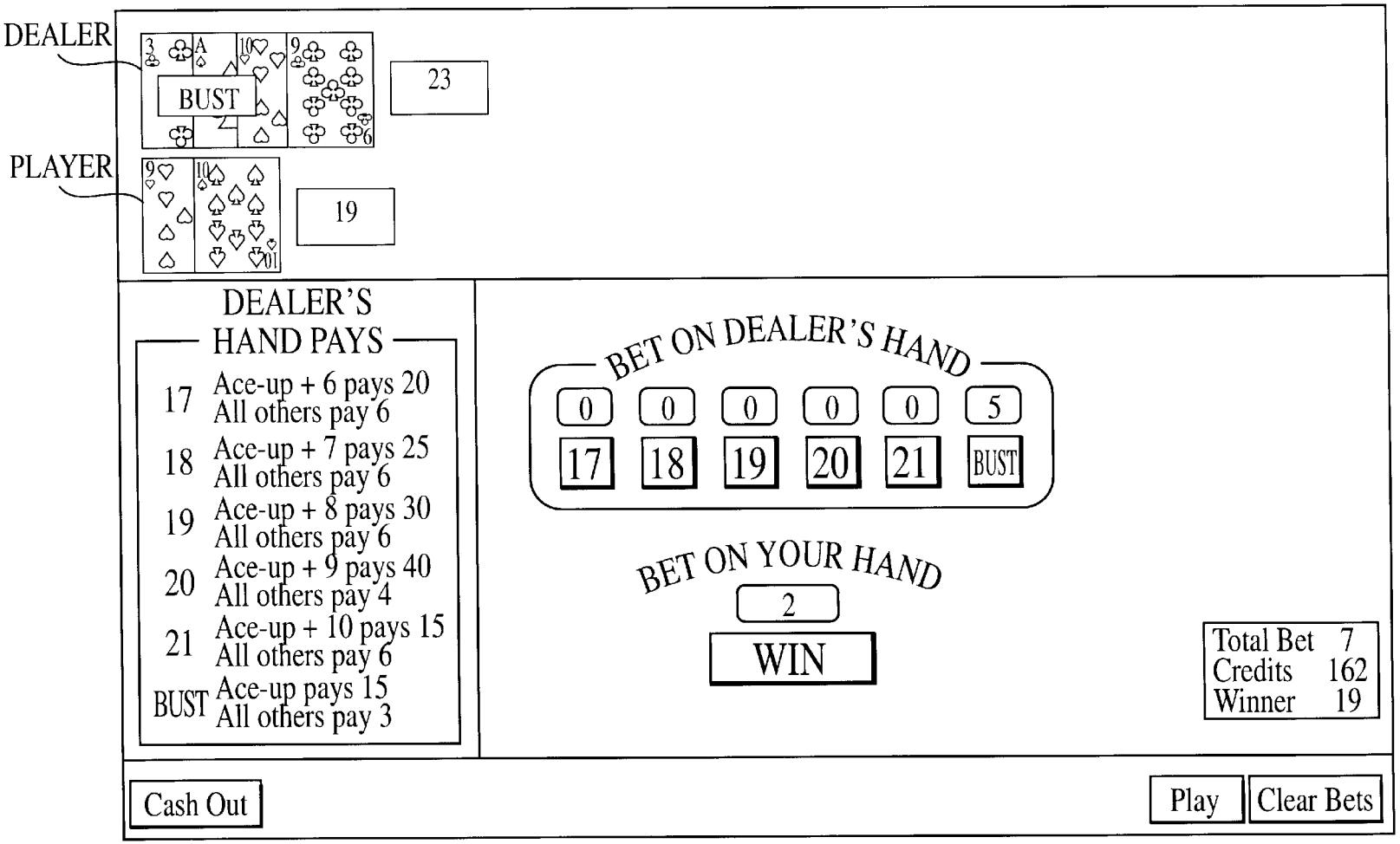
FIG. 21 is a screen display of when the dealer busts in accordance with the player's bets illustrated in FIG. 19, and the player's winning 19 points in FIG. 20.

FIG. 18 is a screen display of the initial or starting screen of modified black jack game. FIG. 19 is a screen display of when the player bets 2 credits on the regular black jack game, and 5 credits on the bust position in modified black jack game. FIG. 20 is a screen display of when the player has received a 19 card hand in accordance with the player's bets illustrated in FIG. 19. FIG. 21 is a screen display of when the dealer busts in accordance with the player's bets illustrated in FIG. 19 and the player's 19 point card hand in FIG. 20. According to this game, the player wins the regular black jack bet, as well as winning the modified black jack game bet.

Figure 22:
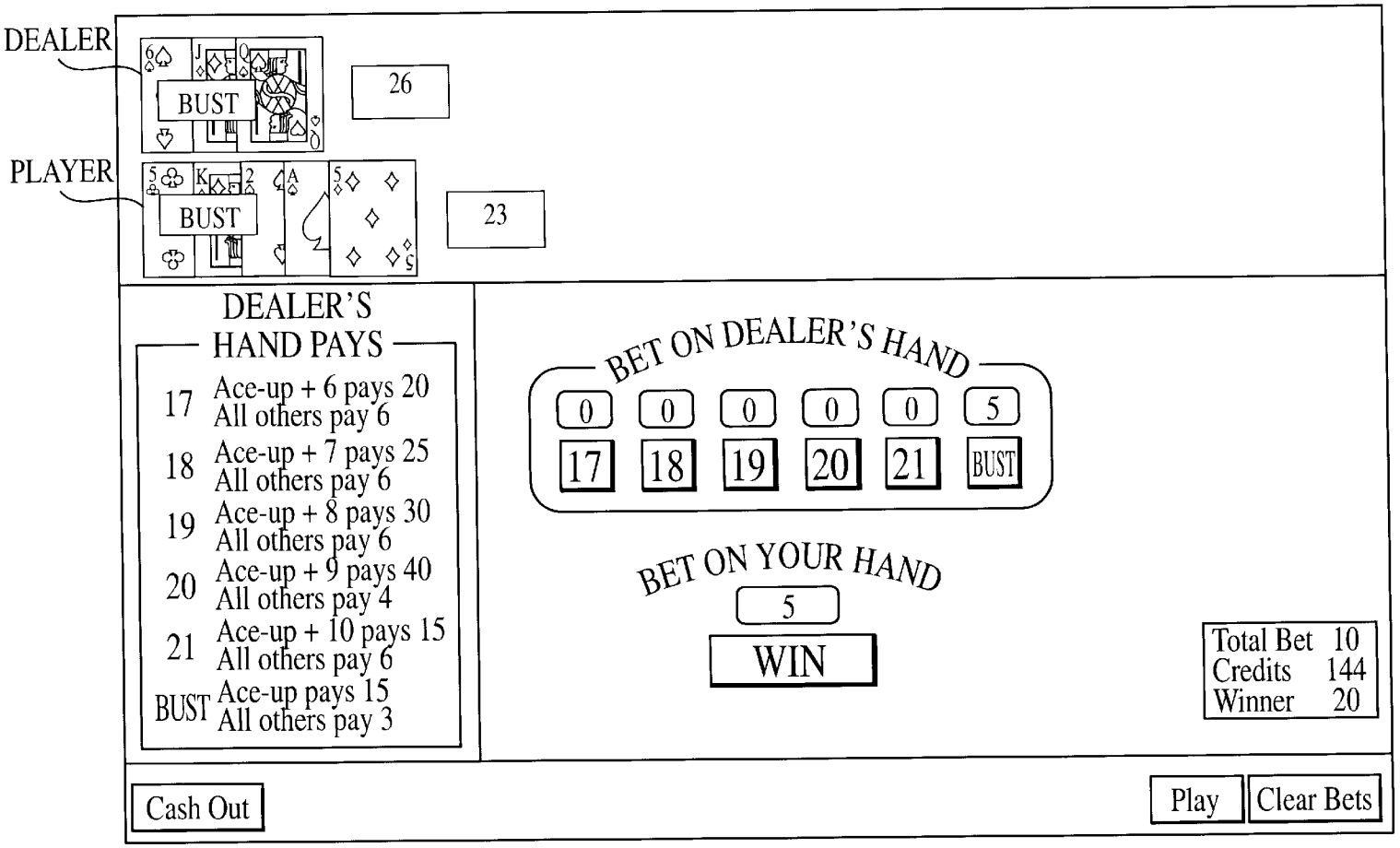
FIG. 22 is a screen display of when both the dealer and the player bust for the modified game of twenty-one.

FIG. 22 is a screen display of when both the dealer and the player bust. Even though the player loses the regular black jack game and wager, the player still wins the modified black jack game wager because the player has bet 5 credits that the dealer will result in a bust hand.

Figure 23:
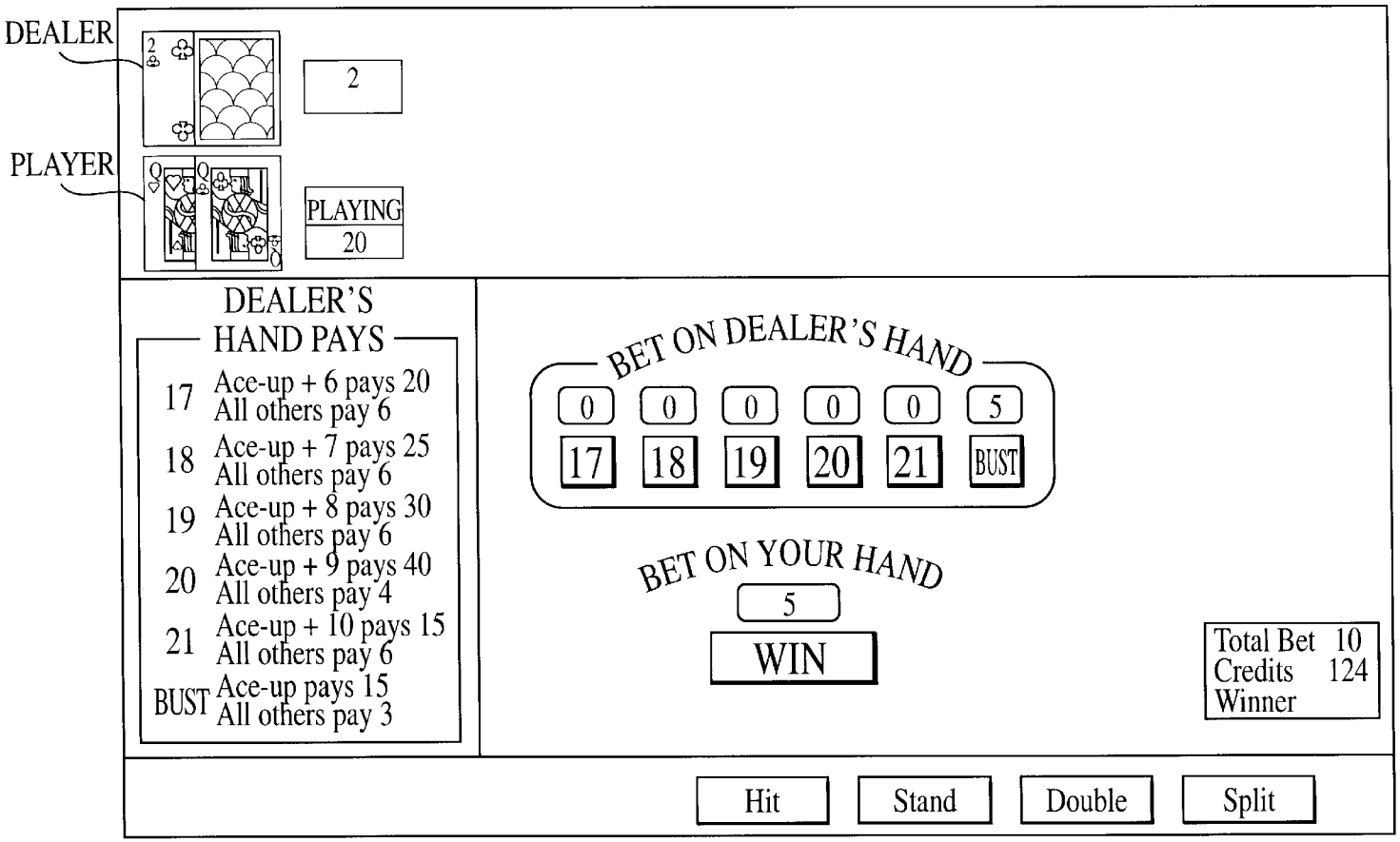
FIG. 23 is a screen display of when the player receives initially two queens, and splits the hand for the modified game of twenty-one.
Figure 24:
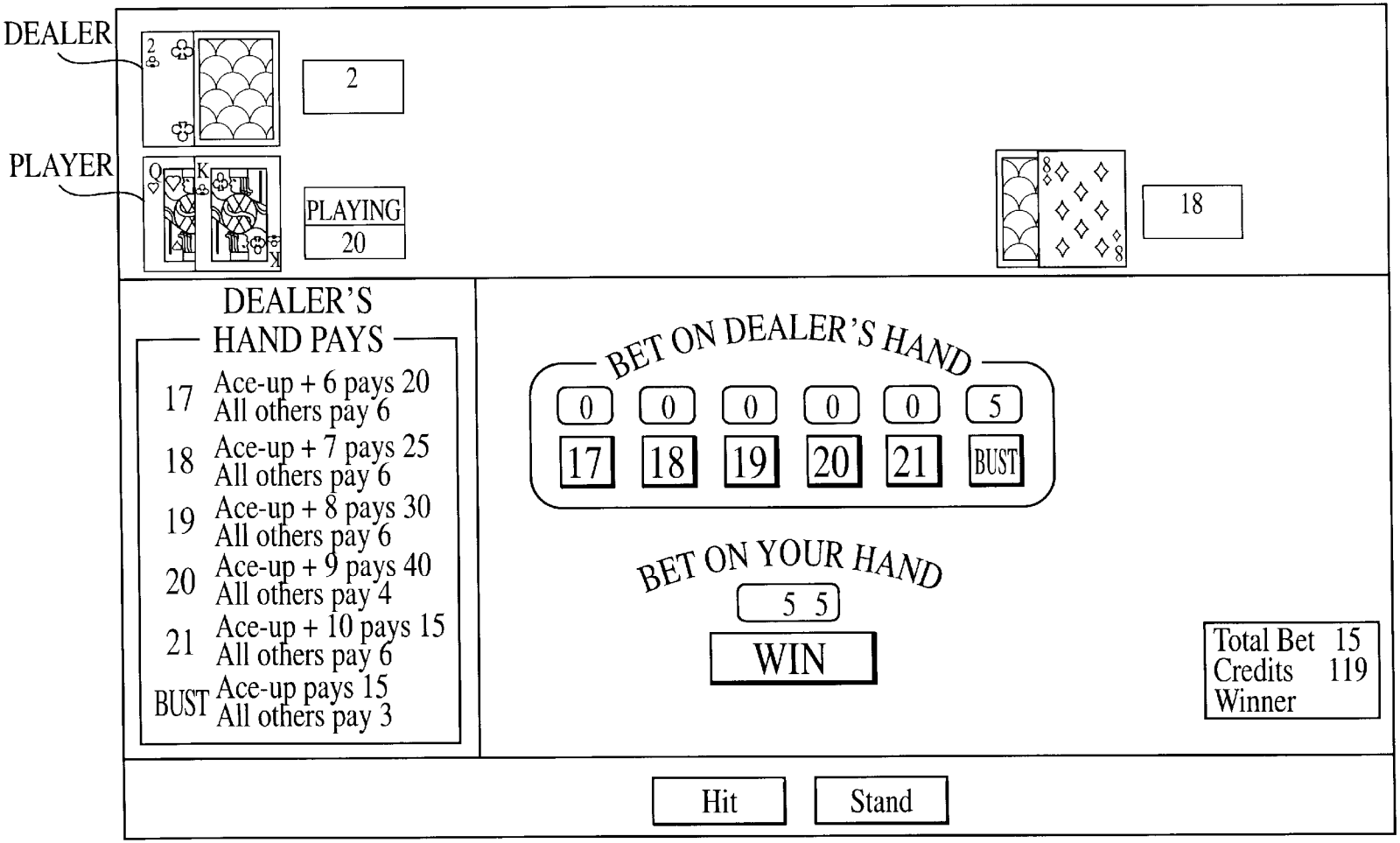
FIG. 24 is a screen display of when the player splits the hand as in FIG. 23, and makes a regular black jack wager of 5 credits for each hand, and 5 credits that the dealer will bust the modified game of twenty-one.

FIG. 23 is a screen display of when the player receives initially two queens, and splits the hand. FIG. 24 is a screen display of when the player splits the hand as in FIG. 22, and makes a regular black jack wager of 59 credits for each hand, and 5 credits that the dealer will bust.

Figure 25:
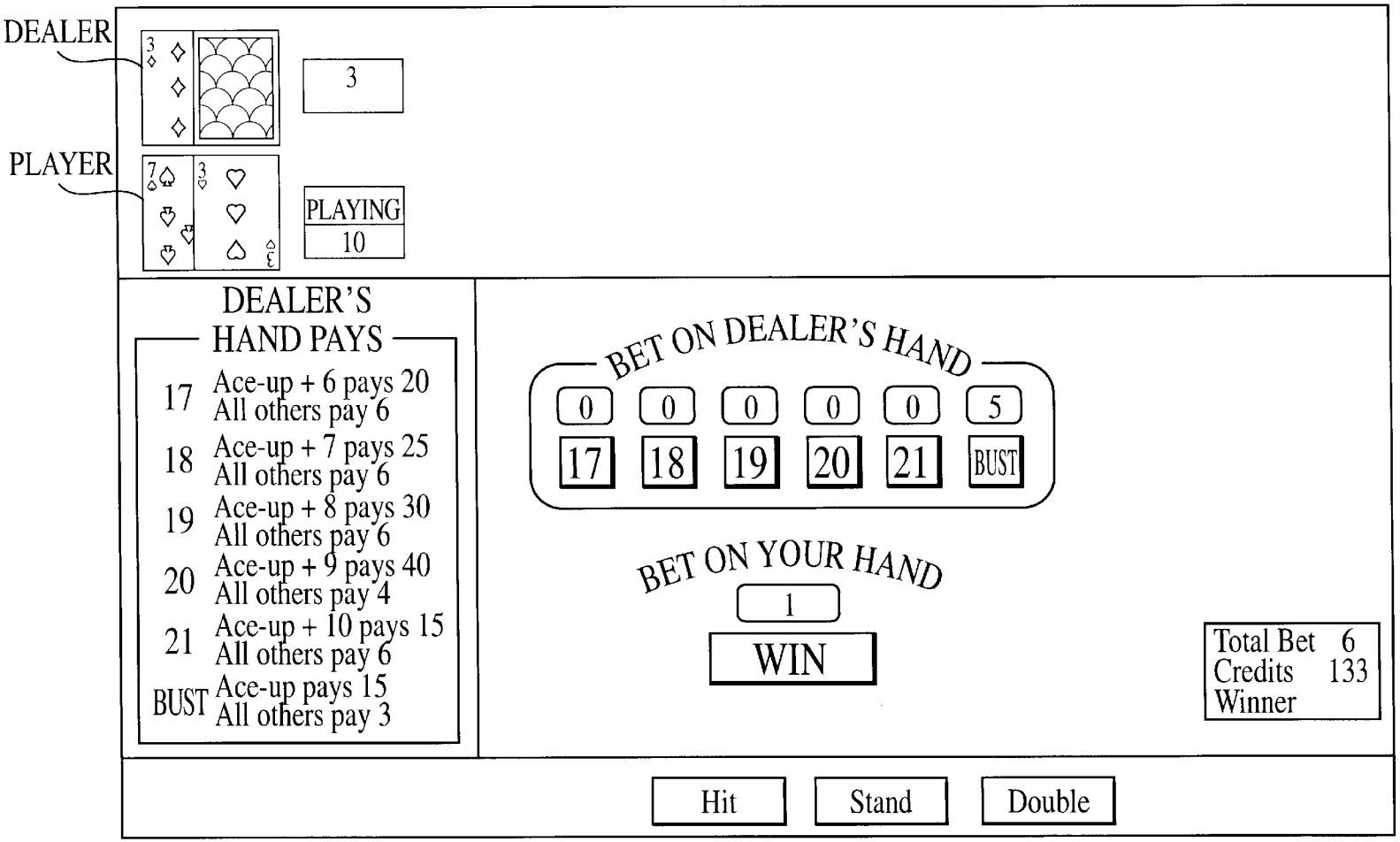
FIG. 25 is a screen display of when the player receives initially a 7 and a 3 card totalling 10, and doubles down the bet for the modified game of twenty-one.
Figure 26:
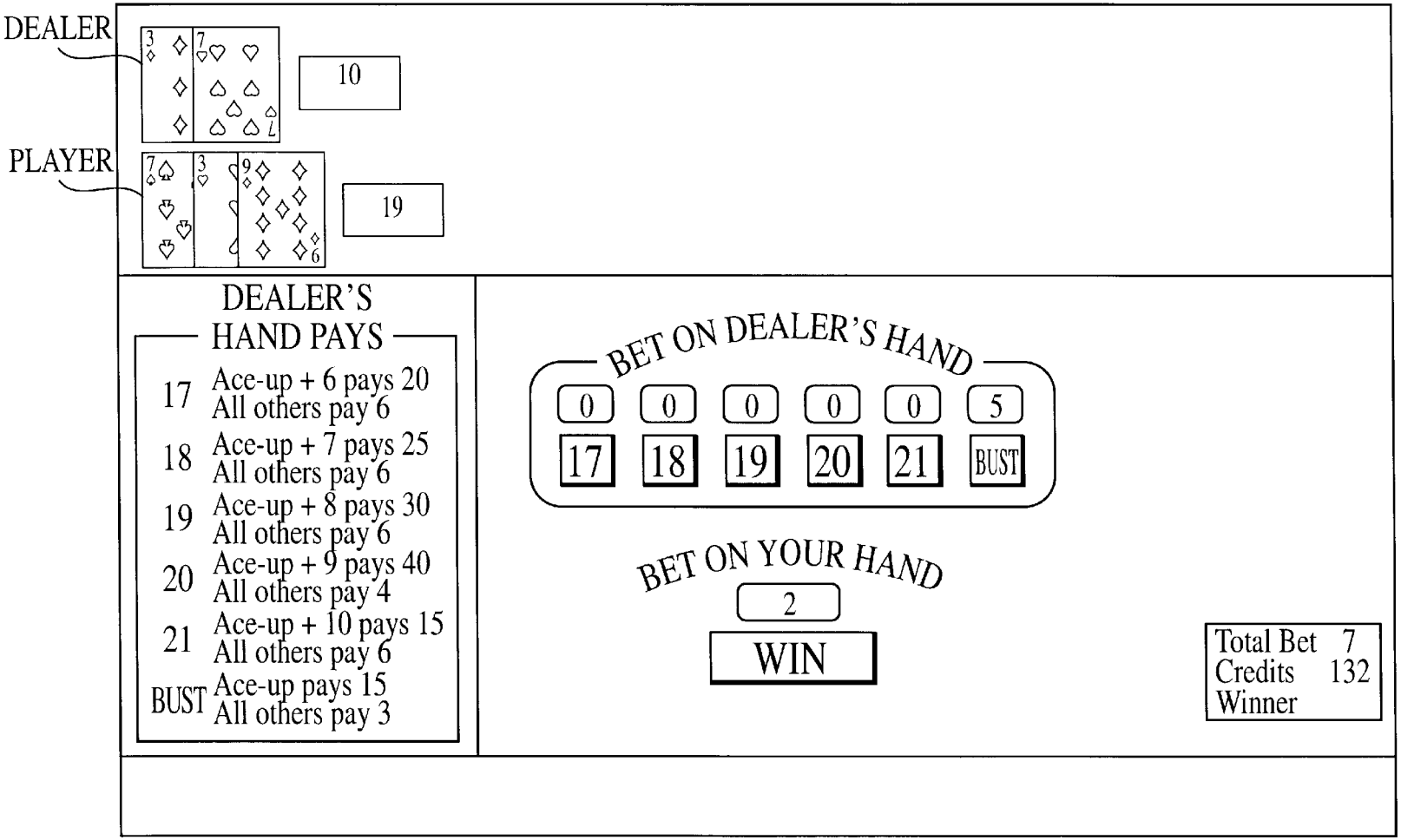
FIG. 26 is a screen display of when the player has doubled down the bet as in FIG. 25, and after the player has won twice the initial bet of 1 credit for the modified game of twenty-one.

FIG. 25 is a screen display of when the player receives initially a 7 and a 3 card totalling 10, and doubles down the bet. FIG. 26 is a screen display of when the player has doubled down the bet as in FIG. 25, and after the player has won twice the initial bet of 1 credit.

Figure 27:
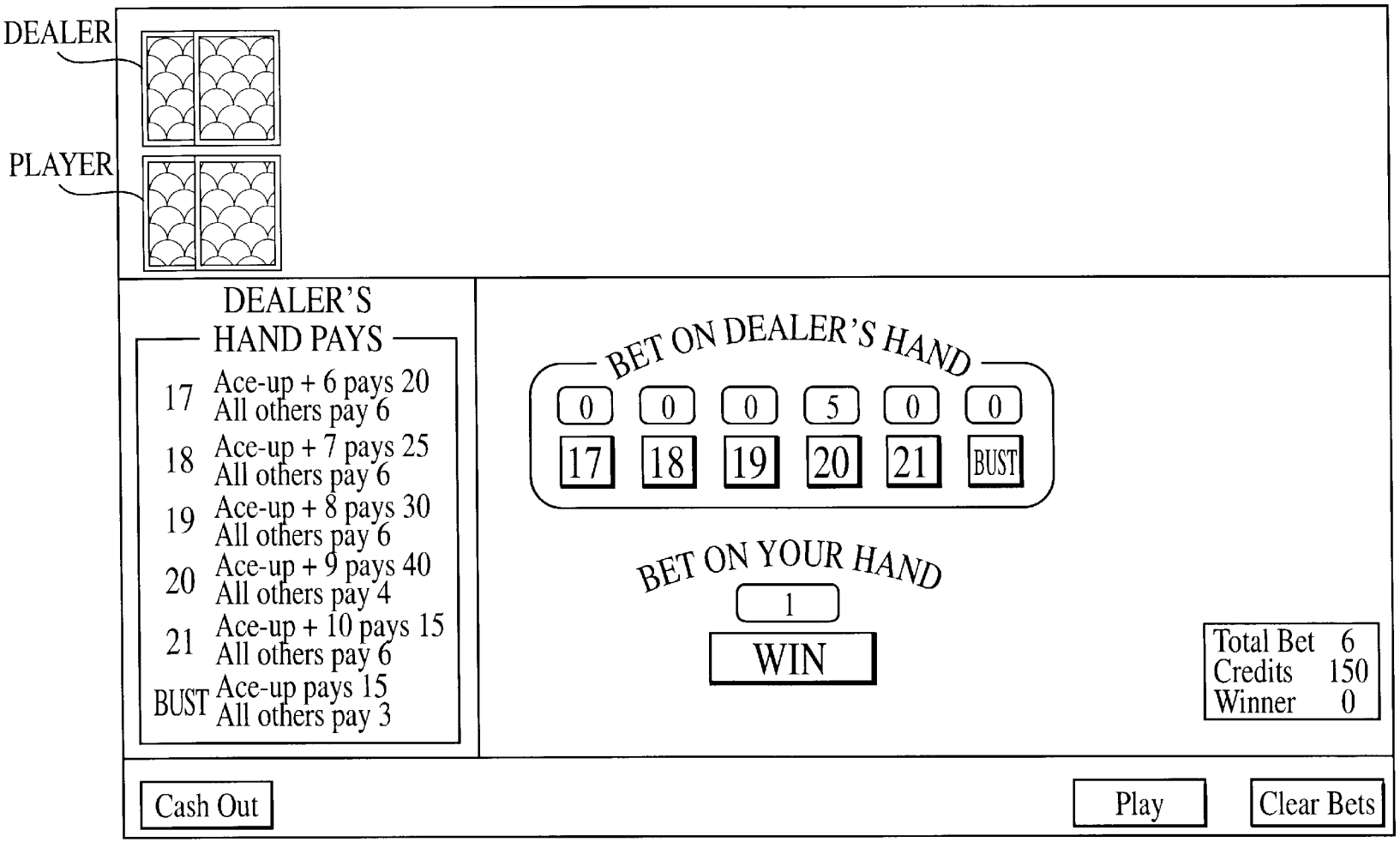
FIG. 27 is a screen display of when the player bets 1 credits on the regular black jack game, and 5 credits on the dealer 20 position for the modified game of twenty-one.
Figure 28:
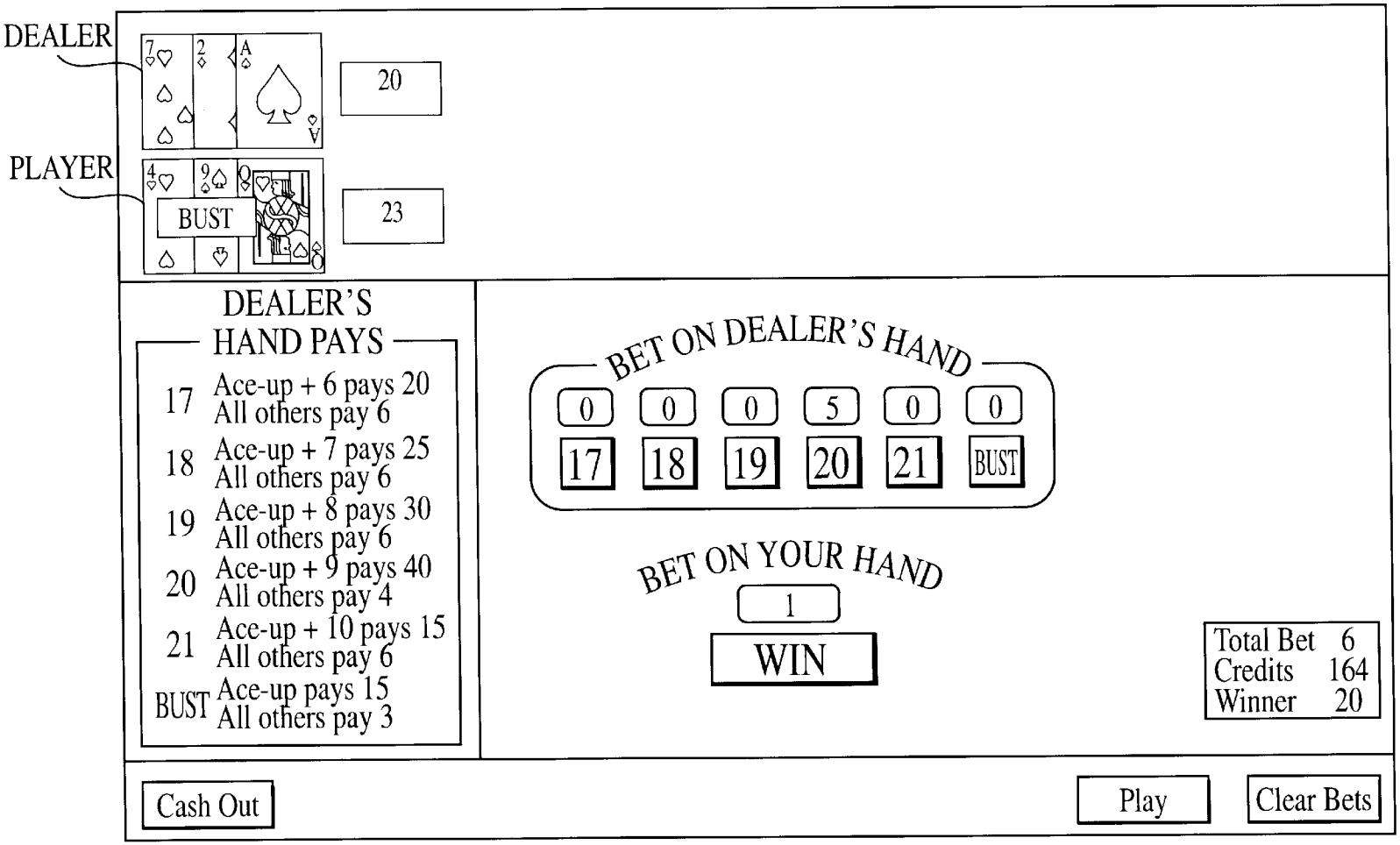
FIG. 28 is a screen display of when the dealer receives or sticks on a 20, and the player busts in accordance with the bet of FIG. 27 for the modified game of twenty-one.

FIG. 27 is a screen display of when the player bets 1 credits on the regular black jack game, and 5 credits on the dealer 20 position in modified black jack game. FIG. 28 is a screen display of when the dealer receives or sticks on a 20, and the player busts in accordance with the bet of FIG. 27. Even though the player loses the regular black jack game and wager, the player still wins the modified black jack game wager because the player has bet 5 credits that the dealer will result in a 20 point card hand.

The modified black jack game is a natural multi-player game against a dealer. This multi-player feature may be used in the video game machine. Assume that the video game allows for two or more players then the following is possible:

a) an individual can play more than one hand at a time against the dealer.

b) two players can share the same machine, using a "love seat" concept the two players share the winnings and losses. A perfect game for couples or friends.

c) two or more players can play using separate Credit Totals

The modified black jack game offers the casino at least five significant advantages:

1. Without any additional effort by the dealer or time between hands, the player(s) is encouraged to place more wagers.
2. There are no strategy changes for the player to learn, as far as, playing the generic game of Black Jack. The new wagering scheme is totally independent of the generic game strategy.
3. The excitement and interest level for the players is dramatically changed. There will be cross-over players who come to this game for the action.
4. The wagering scheme contains an inherent fine tuning mechanism for modifying the casino's hold percentage. That is, the Ace Up bonus payoffs can easily be changed to allow for minor hold percentage changes. This has great importance to the casino in jurisdictions where the hold percentage is constrained (especially true for the video game version).
5. Most importantly, the modified black jack game does not prevent a player who wishes just to play generic Black Jack from doing so. Therefore the casino does not have to worry about having separate tables for standard Black Jack—they are contained within the modified black jack game tables.

In addition to the above features and rules of the modified black jack game, we have also determined that the following additional scoring/payoffs are possible. For example, the first additional payoff is when the dealer obtains a 20 score by obtaining the cards in the sequential order of ace, 2, 3 and 4. If a player bets on 20 (or perhaps no bet may be required for this first additional payoff) and the dealer shows an ace and winds up with 20 consisting of an ace, 2, 3 and 4, precisely those cards in that sequence, the player obtains increased odds, for example, 100 to 1. It is not easy for the dealer to get 20 without this sequence of ace, 2, 3 and 4, because, for example, ace, 2, 4 is 17 and the dealer must stick in accordance with the standard black jack rules. An ace, 3, 4 is 18 and the dealer must also stick with this number. The odds of an ace, 2, 3, followed by a 4 are a few thousand to 1, providing the greatly enhanced payoff.

A second enhanced payoff is if the dealer starts with an ace and winds up with ace, 2, 3, 4, 5, 6, which adds up to 21 and that can only be accomplished in one particular way. The dealer starts with an ace, 2, 3 and the next card must be a 6 to give you 12 to for the ace to be a 1, not a 10 since the dealer would bust if the ace was considered an 11. Then followed by a 4, because a 5 would make 17. That's 4.3 million to 1 for the dealer having the sequential hand of ace, 2, 3, 6, 4, 5 to make 21.

Note that the dealer does not have the option of treating the ace as a 1 or 11 value. Rather, if the ace will bust the dealer, then the dealer must treat it as a 1. This second enhanced payoff is even greater than the first payoff, and may be, for example, 25,000.

Both the first and second enhanced payoffs are totally consistent with the rest of the modified black jack game because they require the dealer to have as the first card an ace—which compliments the already enhanced or modified black jack game payoffs for ace +(6, 7, 8, or 9) dealer results, described in detail above. Thus, players become excited when the dealer's first card is an ace because the payoffs are greatly enhanced. On the other hand, standard insurance works quite differently, without providing enhanced payoffs.

A third enhanced payoff/reward is if the dealer has, for example, the 21 score using the cards ace, 2, 3, 4, 5, 6, and all cards are in the same suit. This third enhanced payoff would be, for example, the million dollar payoff. Advantageously, this million dollar payoff does not even effect the overall odds of the modified black jack game because the chances are so ridiculously small of obtaining this million dollar payoff.

The million dollar payoff may be funded as a progressive jackpot with two different tiers of payoffs. Since this third enhanced payoff is so rare, the player might not even be required to make any bet whatsoever on the dealer, i.e., no modified black jack game bet might even be required, or a modified black jack game bet on 20 or 21 may not be required.

In the progressive jackpot, a quarter of 1% of every play may be deposited against the progressive as an escrow account, and it builds up and builds up and once in awhile somebody collects. This enhanced third payoff is a natural progressive.

Alternative bonus payoffs are as follows:

| Dealer Hand | Payoff |
|---|---|
| ace up & black jack down | 100 units |
| ace up & 5-card charley | 150 units |
| ace up & 6-card charley | 1,000 units + progressive |
| ace up & 7-card charley | 10,000 units + progressive |
| ace up & 8-card charley | 1,000,000 units + progress |
| ace up & 9-card charley | 1,000,000 units + progress |

For the above card combinations, the 5–9 card charleys may total anywhere between 17 to 21 points. One of the important components of the above enhanced and progressive payoffs is that each of these must start with the first card to the dealer being an ace.

FIGS. 29A–29C are tables illustrating alternate payoffs for this progressive feature of the modified black jack game, of course, still other enhanced payoff schemes may also be provided. For example, enhanced payoffs may be provided for dealer combinations of cards in the same suit. Suitable payoffs may be provided for these dealer combination of cards with the same suit. Alternatively, because of the low probability of these enhanced payoffs, the enhanced payoffs may also be provided for player card combinations.

Figure 31:
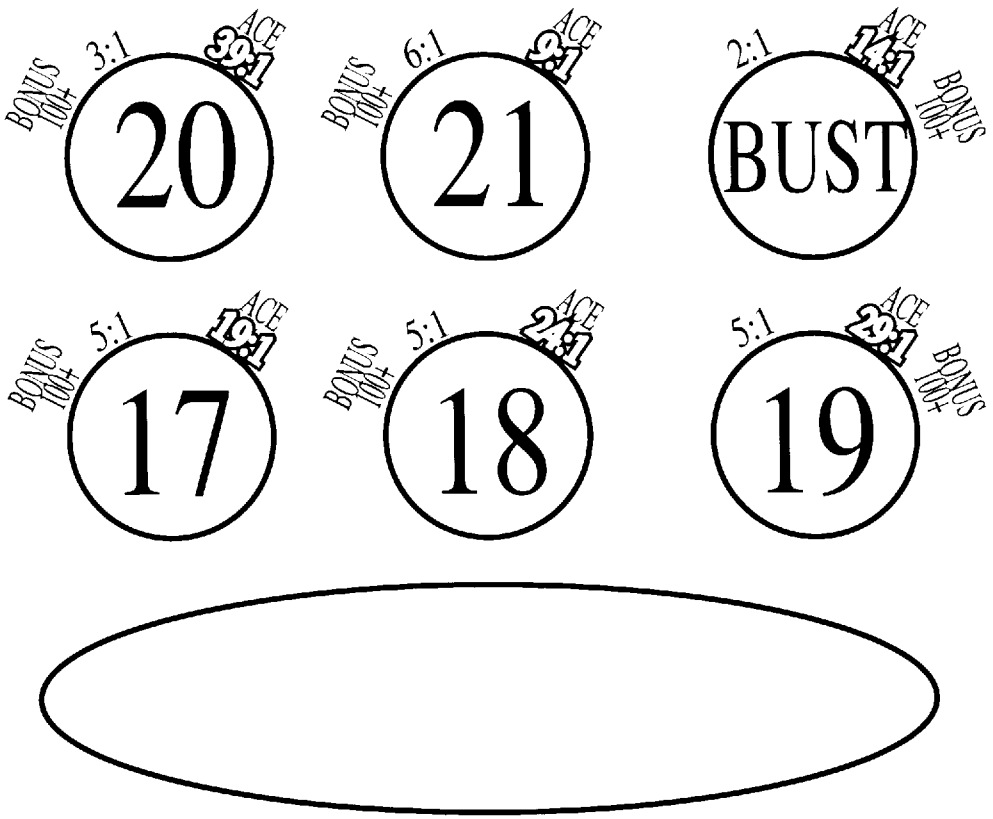
FIG. 31 is an illustration of the progressive or jackpot aspect of the modified game of twenty-one designed for table play.

FIG. 31 is an illustration of the progressive or jackpot aspect of the modified game of twenty-one designed for table play. For example, for the single 17 bet, the player wins 5:1 if the dealer attains a 17 without an ace card dealt as the first card, and the player wins 19:1 if the dealer attains a 17 with an ace card dealt as the first card. In addition, the player also wins enhanced odds if the dealer attains a 17 with a predetermined number/kind of cards. For example, enhanced odds are provided, as described above, if the dealer attains a 17 with 5 or more cards (i.e., 5 card charley, and above), with cards of the same suit, and the like. Note that placement of a wager on a single area (e.g., 17, 18 and/or the like) allows the player to be eligible for all enhanced payoffs with a single wager.

Figure 32:
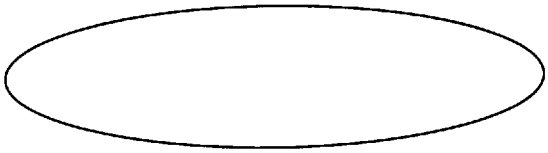
FIG. 32 is an illustration of another progressive or jackpot aspect of the modified game of twenty-one designed for table play.

Alternatively, the player may be required to make a separate wager to be eligible for the jackpot/progressive bet that provides enhanced payoffs. FIG. 32 is an illustration of another progressive or jackpot aspect of the modified game of twenty-one designed for table play. For example, for separate wagers are available for the 17 bet. The player wins 5:1 if the dealer attains a 17 without an ace card dealt as the first card and the player made a wager on the main area of 17. The player wins 19:1 if the dealer attains a 17 with an ace card dealt as the first card, and the player made a wager on the ace area of 17. In addition, the player also wins enhanced odds if the dealer attains a 17 with a predetermined number/kind of cards, and the payer made a wager on the jackpot area of 17. For example, enhanced odds are provided, as described above, if the dealer attains a 17 with 5 or more cards (i.e., 5 card charley, and above), with cards of the same suit, and the like. Note that placement of separate wagers on separate areas (e.g., 17, 18 and/or the like) allows the player to be eligible for all enhanced payoffs with a single wager.

The above described modified black jack game may also be used in a tournament, where players either compete against each other with the same dealer set of cards, same player set of cards, both, or neither. Bridge scoring rules can be used to accumulate points, or credits accumulated in the video slot machine, as an example. See, for example, one or more of the above incorporated by reference patent applications for exemplary network architecture, processes, and point scoring designs.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method of playing a modified twenty-one card game between at least one player and a dealer with a deck of fifty-two playing cards, and a table layout having a playing surface with a plurality of player positions, one for each player, each with plurality of individual dealer bet areas on each of said player positions, each of said player positions including distinguishable dealer bet areas representing a final dealer hand count of 17, a final dealer hand count of 18, a final dealer hand count of 19, a final dealer hand count of 20, a final dealer hand count of 21, and a final dealer hand count of bust, comprising the steps of:

(a) each player placing a first wager to participate in playing the twenty-one game;

(b) each player selecting a number of said dealer bet areas, and placing second wagers on the dealer bet areas selected, said number of second wagers allowed to be placed ranging from placing one second wager on one of said dealer bet areas, up to placing a plurality of second wagers, one on each of said dealer bet areas;

(c) initially dealing a hand of two cards to each player, and dealing a hand of two cards to the dealer to form the dealer hand, dealing additional cards to players electing to receive more cards according to standard rules of twenty-one, determining a final dealer hand count by following standard predetermined house rules of twenty-one;

(d) determining the final dealer hand count;

(e) determining whether the player beats the dealer in the twenty-one game, and if so, awarding the player responsive to the first wager; and (f) comparing the final dealer hand count to the at least one of the 17, 18, 19, 20, 21 or bust dealer bet areas wherein said second wagers was placed in placing step (b), and awarding the player responsive to the second wagers and a coincidence between the final dealer hand count and the at least one of the 17, 18, 19, 20, 21 or bust.

2. A method according to claim 1, wherein said awarding step (f), further comprises the step of awarding the player approximately 5 to 1 when the final dealer hand count comprises 17, 18 or 19, awarding the player approximately 3 to 1 when the final dealer hand count comprises 20, awarding the player approximately 6 to 1 when the final dealer hand count comprises 21, and awarding the player approximately 2 to 1 when the final dealer hand count comprises bust.

3. A method according to claim 1, wherein said awarding step (f), further comprises the step of awarding the player a first amount, when the final dealer hand count comprises 17, 18 or 19, awarding the player a second amount less than the first amount, when the final dealer hand count comprises 20, awarding the player a third amount greater than the first amount when the final dealer hand count comprises 21, and awarding the player a fourth amount less than the second amount when the final dealer hand count comprises bust.

4. A method according to claim 1, wherein said awarding step (f), further comprises the step of awarding the player one or more enhanced awards when the final dealer hand count comprises an ace and 6 for the final dealer hand count of 17, an ace and 7 for the final dealer hand count of 18, an ace and 8 for the final dealer hand count of 19, an ace and 9 for the final dealer hand count of 20, and an ace and a 10 value card for the final dealer hand count of 21.

5. A method according to claim 1, wherein said awarding step (f) , further comprises the step of awarding the player one or more enhanced awards when the final dealer hand count includes an ace dealt to the dealer as the first card.

6. A method according to claim 1, wherein said awarding step (f), further comprises the step of awarding the player one or more enhanced awards when the final dealer hand count includes a predetermined card combination.

7. A method according to claim 1, wherein said awarding step (f), further comprises the step of awarding the player one or more enhanced awards when the final dealer hand count includes a predetermined card combination to selectively tune the house advantage.

8. A method of playing a modified twenty-one card game between at least one player and a dealer with a deck of fifty-two playing cards, and a table layout having a playing surface with a plurality of player positions, one for each player, each with at least one of a common and a plurality of individual dealer bet areas on each of said player positions, the at least one common and said player positions including distinguishable dealer bet areas representing at least one of a final dealer hand count of 17, a final dealer hand count of 18, a final dealer hand count of 19, a final dealer hand count of 20, a final dealer hand count of 21, and a final dealer hand count of bust, or a combination of the final dealer hand counts of 17, comprising the steps of:

(a) each player selecting a number of said dealer bet areas, and placing wagers on the dealer bet areas selected, said number of wagers allowed to be placed ranging from placing one wager on one of said dealer bet areas, up to placing a plurality of wagers, one on each of said dealer bet areas;

(b) initially dealing a hand of two cards to at least the dealer to form the dealer hand, dealing additional cards to the at least the dealer to receive more cards according to standard predetermined house rules of twenty-one, and determining a final dealer hand count by following the standard predetermined house rules;

(c) determining the final dealer hand count; and (d) comparing the final dealer hand count to the at least one of the 17, 18, 19, 20, 21 or bust dealer bet areas wherein said wagers was placed in placing step (b), and awarding the player responsive to the wagers and a coincidence between the final dealer hand count and the at least one of the 17, 18, 19, 20, 21 or bust.

9. A method according to claim 8, wherein said awarding step (d), further comprises the step of awarding the player approximately 5 to 1 when the final dealer hand count comprises 17, 18 or 19, awarding the player approximately 3 to 1 when the final dealer hand count comprises 20, awarding the player approximately 6 to 1 when the final dealer hand count comprises 21, and awarding the player approximately 2 to 1 when the final dealer hand count comprises bust.

10. A method according to claim 8, wherein said awarding step (d), further comprises the step of awarding the player a first: amount, when the final dealer hand count comprises 17, 18 or 19, awarding the player a second amount less than the first amount, when the final dealer hand count comprises 20, awarding the player a third amount greater than the first amount when the final dealer hand count comprises 21, and awarding the player a fourth amount less than the second amount when the final dealer hand count comprises bust.

11. A method according to claim 8, wherein said awarding step (d), further comprises the step of awarding the player one or more enhanced awards when the final dealer hand count comprises an ace and 6 for the final dealer hand count of 17, an ace and 7 for the final dealer hand count of 18, an ace and 8 for the final dealer hand count of 19, an ace and 9 for the final dealer hand count of 20, and an ace and a 10 value card for the final dealer hand count of 21.

12. A method according to claim 8, wherein said awarding step (d), further comprises the step of awarding the player one or more enhanced awards when the final dealer hand count includes an ace dealt to the dealer as the first card.

13. A method according to claim 8, wherein said awarding step (d), further comprises the step of awarding the player one or more enhanced awards when the final dealer hand count includes a predetermined card combination.

14. A method according to claim 8, wherein said awarding step (d), further comprises the step of awarding the player one or more enhanced awards when the final dealer hand count includes a predetermined card combination to selectively tune the house advantage.

15. A method of playing a modified twenty-one card game between at least one player and a dealer with a deck of fifty-two playing cards, and a table layout having a playing surface with a plurality of player positions, one for each player, with at least one of a common and a plurality of individual dealer bet areas on each of said player positions, each of said player positions including distinguishable dealer bet areas representing all potential final dealer hand counts, comprising the steps of:

(a) each player selecting a number of said dealer bet areas, and placing wagers on the dealer bet areas selected, said number of wagers allowed to be placed ranging from placing one wager on one of said dealer bet areas, up to placing a plurality of wagers, on at least two and up to all of said dealer bet areas representing all potential final dealer hand counts;

(b) initially dealing a hand of two cards to at least the dealer to form the dealer hand, dealing additional cards to the dealer to receive more cards according to standard predetermined rules of twenty-one;

(c) determining the final dealer hand count by following the standard predetermined rules; and (d) comparing the final dealer hand count to the dealer bet areas wherein said wagers were placed in placing step (a), and awarding the player responsive to the wagers and a coincidence between the final dealer hand count and the dealer bet areas.

16. A method according to claim 15, wherein said awarding step (d), further comprises the step of awarding the player approximately 5 to 1 when the final dealer hand count comprises 17, 18 or 19, awarding the player approximately 3 to 1 when the final dealer hand count comprises 20, awarding the player approximately 6 to 1 when the final dealer hand count comprises 21, and awarding the player approximately 2 to 1 when the final dealer hand count comprises bust.

17. A method according to claim 15, wherein said awarding step (d), further comprises the step of awarding the player a first amount, when the final dealer hand count comprises 17, 18 or 19, awarding the player a second amount less than the first amount, when the final dealer hand count comprises 20, awarding the player a third amount greater than the first amount when the final dealer hand count comprises 21, and awarding the player a fourth amount less than the second amount when the final dealer hand count comprises bust.

18. A method according to claim 15, wherein said awarding step (d), further comprises the step of awarding the player one or more enhanced awards when the final dealer hand count comprises an ace and 6 for the final dealer hand count of 17, an ace and 7 for the final dealer hand count of 18, an ace and 8 for the final dealer hand count of 19, an ace and 9 for the final dealer hand count of 20, and an ace and a 10 value card for the final dealer hand count of 21.

19. A method according to claim 15, wherein said awarding step (d), further comprises the step of awarding the player one or more enhanced awards when the final dealer hand count includes an ace dealt to the dealer as the first card.

20. A method according to claim 15, wherein said awarding step (d), further comprises the step of awarding the player one or more enhanced awards when the final dealer hand count includes a predetermined card combination.

21. A method according to claim 15, wherein said awarding step (d), further comprises the step of awarding the player one or more enhanced awards when the final dealer hand count includes a predetermined card combination to selectively tune the house advantage.

22. A method of playing a modified twenty-one card game between at least one player and a dealer with a deck of fifty-two playing cards, and a table layout having a playing surface with a plurality of player positions, one for each player, with at least one of a common and a plurality of individual dealer bet areas on each of said player positions, each of said player positions including distinguishable dealer bet areas representing all potential final dealer hand counts, comprising the steps of:

(a) each player selecting a number of said dealer bet areas, and placing wagers on the dealer bet areas selected, said number of wagers allowed to be placed ranging from placing one wager on one of said dealer bet areas, up to placing a plurality of wagers, on at least two and up to all of said dealer bet areas representing all potential final dealer hand counts;

(b) initially dealing a hand of two cards to at least the dealer to form the dealer hand, dealing additional cards to the dealer to receive more cards according to standard predetermined rules of twenty-one;

(c) determining the final dealer hand count by following the standard predetermined rules; and (d) comparing the final dealer hand count to the dealer bet areas wherein said wagers were placed in placing step (a), and awarding the player responsive to the wagers and a coincidence between the final dealer hand count and the dealer bet areas, the final dealer hand counts comprising at least one of, suited or unsuited, ace first and 5 card charley, ace first and 6 card charley, ace first and 7 card charley, ace first and 8 card charley, ace first and 9 card charley, sequential order of ace 2 3 6 4 5, and sequential order of ace, 2, 3 and 4.

23. A method according to claim 22, wherein said awarding step (d), further comprises the step of awarding the player approximately 5 to 1 when the final dealer hand count comprises 17, 18 or 19, awarding the player approximately 3 to 1 when the final dealer hand count comprises 20, awarding the player approximately 6 to 1 when the final dealer hand count comprises 21, and awarding the player approximately 2 to 1 when the final dealer hand count comprises bust.

24. A method according to claim 22, wherein said awarding step (d), further comprises the step of awarding the player a first amount, when the final dealer hand count comprises 17, 18 or 19, awarding the player a second amount less than the first amount, when the final dealer hand count comprises 20, awarding the player a third amount greater than the first amount when the final dealer hand count comprises 21, and awarding the player a fourth amount less than the second amount when the final dealer hand count comprises bust.

25. A method according to claim 22, wherein said awarding step (d), further comprises the step of awarding the player one or more enhanced awards when the final dealer hand count comprises an ace and 6 for the final dealer hand count of 17, an ace and 7 for the final dealer hand count of 18, an ace and 8 for the final dealer hand count of 19, an ace and 9 for the final dealer hand count of 20, and an ace and a 10 value card for the final dealer hand count of 21.

26. A method according to claim 22, wherein said awarding step (d), further comprises the step of awarding the player one or more enhanced awards when the final dealer hand count includes an ace dealt to the dealer as the first card.

27. A method according to claim 22, wherein said awarding step (d), further comprises the step of awarding the player one or more enhanced awards when the final dealer hand count includes a predetermined card combination.

28. A method according to claim 22, wherein said awarding step (d), further comprises the step of awarding the player one or more enhanced awards when the final dealer hand count includes a predetermined card combination to selectively tune the house advantage.

* * * * *